US008721206B2

(12) United States Patent
Horade

(10) Patent No.: US 8,721,206 B2
(45) Date of Patent: May 13, 2014

(54) IMAGE RECORDING APPARATUS

(75) Inventor: Kenta Horade, Tokai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 411 days.

(21) Appl. No.: 13/047,151

(22) Filed: Mar. 14, 2011

(65) Prior Publication Data

US 2011/0293348 A1 Dec. 1, 2011

(30) Foreign Application Priority Data

May 25, 2010 (JP) ..... 2010-119852

(51) Int. Cl.
*B41J 11/00* (2006.01)

(52) U.S. Cl.
USPC ..... 400/582; 400/579; 400/596; 400/624; 400/630

(58) Field of Classification Search
USPC ..... 101/485; 400/582, 579, 630, 623, 596
See application file for complete search history.

(56) References Cited

U.S. PATENT DOCUMENTS

| | | | | |
|---|---|---|---|---|
| 5,167,409 | A * | 12/1992 | Higeta | 271/225 |
| 5,678,159 | A * | 10/1997 | Williams et al. | 399/395 |
| 5,715,514 | A * | 2/1998 | Williams et al. | 399/395 |
| 6,898,382 | B2 * | 5/2005 | Shibaki | 399/16 |
| 2002/0048475 | A1 * | 4/2002 | Kojima | 399/405 |
| 2004/0126162 | A1 * | 7/2004 | Nishino et al. | 399/395 |
| 2006/0171725 | A1 * | 8/2006 | Ruthenberg et al. | 399/16 |
| 2006/0203025 | A1 * | 9/2006 | Nakata et al. | 347/16 |
| 2008/0289527 | A1 * | 11/2008 | Pasuch et al. | 101/474 |
| 2009/0003908 | A1 * | 1/2009 | Horade | 399/395 |
| 2009/0196662 | A1 * | 8/2009 | Boness et al. | 399/301 |
| 2009/0220873 | A1 * | 9/2009 | Enomoto | 430/30 |

FOREIGN PATENT DOCUMENTS

| | | |
|---|---|---|
| JP | H5-068146 | 3/1993 |
| JP | H6-086945 | 12/1994 |
| JP | H11-088654 | 3/1999 |
| JP | H11-170640 | 6/1999 |
| JP | 2000-6478 | 1/2000 |
| JP | 2001001584 A | 1/2001 |
| JP | 2003-205654 | 7/2003 |
| JP | 2007145577 A | 6/2007 |

OTHER PUBLICATIONS

Notice of Reasons for Rejection dated Jan. 21, 2014 received from the Japanese Patent Office in counterpart Japanese Patent Application No. 2010-119852.

* cited by examiner

*Primary Examiner* — David Banh
(74) *Attorney, Agent, or Firm* — Scully, Scott, Murphy & Presser, P.C.

(57) ABSTRACT

An image recording apparatus includes: at least one roller pair which has a driving roller and a driven roller facing the driving roller and which rotates while interposing the recording medium therebetween to transport the recording medium in a first direction; a recording section which records an image on the recording medium transported by the roller pair; a position detecting section which detects a position of the recording medium with respect to the roller pair in a second direction perpendicular to the first direction before the recording section starts recording; a determining section which determines a rotation amount of the driving roller before the recording section starts the recording depending on the position in the second direction of the recording medium detected by the position detecting section; and a control unit which controls the driving roller based on the rotation amount determined by the determining section.

8 Claims, 28 Drawing Sheets

Fig. 20A

| INTERPOSED STATE | INTERPOSED STATE 1 | | INTERPOSED STATE 2 | | | |
|---|---|---|---|---|---|---|
| ROLLERS TO BE ABUTTED | c, d, e, f | c, d, e, f,g | c, d, e, f AND E, F, G, H, I | c, d, e, f AND D, E, F, G, H, I | c, d, e, f, g AND E, F, G, H, I, J | c, d, e, f AND E, F, G, H, I, J |
| ROTATION AMOUNT (mm) | ROTATION AMOUNT 1 | ROTATION AMOUNT 2 | ROTATION AMOUNT 3 | ROTATION AMOUNT 4 | ROTATION AMOUNT 5 | ROTATION AMOUNT 6 |
| INTERPOSED STATE | INTERPOSED STATE 3 | | | | | |
| ROLLERS TO BE ABUTTED | D,E, F, G, H, | D, E, F, G, H, I | E, F, G, H, I, J | E, F, G, H, I, | | |
| ROTATION AMOUNT (mm) | ROTATION AMOUNT 7 | ROTATION AMOUNT 8 | ROTATION AMOUNT 9 | ROTATION AMOUNT 10 | | |

Fig. 20B

| INTERPOSED STATE | INTERPOSED STATE 1 | | INTERPOSED STATE 2 | | | |
|---|---|---|---|---|---|---|
| ROLLERS TO BE ABUTTED | c, d, e, f | c, d, e, f,g | c, d, e, f AND E, F, G, H, I | c, d, e, f AND D, E, F, G, H, I | c, d, e, f, g AND E, F, G, H, I, J | c, d, e, f AND E, F, G, H, I, J |
| CORRECTION COEFFICIENT (%) | k1 | k2 | k3 | k4 | k5 | k6 |
| INTERPOSED STATE | INTERPOSED STATE 3 | | | | | |
| ROLLERS TO BE ABUTTED | D,E, F, G, H | D, E, F, G, H, I | E, F, G, H, I, J | E, F, G, H, I | | |
| CORRECTION COEFFICIENT (%) | k7 | k8 | k9 | k10 | | |

Fig. 21A

| RECORDING PAPER SIDE END POSITION | POSITION OF RECORDING PAPER P1 | | |
|---|---|---|---|
| OBLIQUE TRANSPORT AMOUNT | NO OBLIQUE TRANSPORT AMOUNT | | |
| INTERPOSED STATE | INTERPOSED STATE 1 | INTERPOSED STATE 2 | INTERPOSED STATE 3 |
| ROTATION AMOUNT (mm) | ROTATION AMOUNT 1 | ROTATION AMOUNT 4 | ROTATION AMOUNT 8 |

Fig. 21B

| RECORDING PAPER SIDE END POSITION | POSITION OF RECORDING PAPER P2 | | |
|---|---|---|---|
| OBLIQUE TRANSPORT AMOUNT | NO OBLIQUE TRANSPORT AMOUNT | | |
| INTERPOSED STATE | INTERPOSED STATE 1 | INTERPOSED STATE 2 | INTERPOSED STATE 3 |
| ROTATION AMOUNT (mm) | ROTATION AMOUNT 2 | ROTATION AMOUNT 5 | ROTATION AMOUNT 9 |

Fig. 21C

| RECORDING PAPER SIDE END POSITION | POSITION OF RECORDING PAPER P3 | | |
|---|---|---|---|
| OBLIQUE TRANSPORT AMOUNT | OBLIQUE TRANSPORT AMOUNT $\cos\theta$ | | |
| INTERPOSED STATE | INTERPOSED STATE 1 | INTERPOSED STATE 2 | INTERPOSED STATE 3 |
| ROTATION AMOUNT (mm) | (ROTATION AMOUNT 1 + ROTATION AMOUNT 2)/2 | (ROTATION AMOUNT 6 + ROTATION AMOUNT 3)/2 | ROTATION AMOUNT 10 |

Fig. 22A

| DRIVEN RUNNER 61 | a | b | c | d | e | f | g |
|---|---|---|---|---|---|---|---|
| CORRECTION COEFFICIENT (%) | k(a) | k(b) | k(c) | k(d) | k(e) | k(f) | k(g) |

Fig. 22B

| SPUR 63 | A | B | C | D | E | F | G | H | I | J | K | L |
|---|---|---|---|---|---|---|---|---|---|---|---|---|
| CORRECTION COEFFICIENT (%) | k(A) | k(B) | k(C) | k(D) | k(E) | k(F) | k(G) | k(H) | k(I) | k(J) | k(K) | k(L) |

Fig. 22C

| INTERPOSED STATE | INTERPOSED STATE 1 | |
|---|---|---|
| ROLLERS TO BE ABUTTED | c,d,e,f, | c,d,e,f,g |
| CORRECTION COEFFICIENT (%) | {k(c) + k(d) + k(e) + k(f)}/4 | {k(c) + k(d) + k(e) + k(f) + k(g)}/5 |

Fig. 22D

| INTERPOSED STATE | INTERPOSED STATE 2 | |
|---|---|---|
| ROLLERS TO BE ABUTTED | c, d, e, f AND E, F, G, H, I | c, d, e, f AND D, E, F, G, H, I |
| CORRECTION COEFFICIENT (%) | [{k(c) + k(d) + k(e) + k(f)}/4 + {k(E) + k(F) + k(G) + k(H) + k(I)}/5]/2 | [{k(c) + k(d) + k(e) + k(f)}/4 + {k(D) + k(E) + k(F) + k(G) + k(H) + k(I)}/6]/2 |

Fig. 22E

| INTERPOSED STATE | INTERPOSED STATE 2 | |
|---|---|---|
| ROLLERS TO BE ABUTTED | c, d, e, f, g AND E, F, G, H, I, J | c, d, e, f AND E, F, G, H, I, J |
| CORRECTION COEFFICIENT (%) | [{k(c) + k(d) + k(e) + k(f) + k(g)}/5 + {k(E) + k(F) + k(G) + k(H) + k(I) + k(J)}/6]/2 | [{k(c) + k(d) + k(e) + k(f)}/4 + {k(E) + k(F) + k(G) + k(H) + k(I) + k(J)}/6]/2 |

Fig. 22F

| INTERPOSED STATE | INTERPOSED STATE 3 | |
|---|---|---|
| ROLLERS TO BE ABUTTED | D, E, F, G, H | D, E, F, G, H, I |
| CORRECTION COEFFICIENT (%) | [k(D) + k(E) + k(F) + k(G) + k(H)]/5 | {k(D) + k(E) + k(F) + k(G) + k(H) + k(I)}/6 |

Fig. 22G

| INTERPOSED STATE | INTERPOSED STATE 3 | |
|---|---|---|
| ROLLERS TO BE ABUTTED | E, F, G, H, I, J | E, F, G, H, I |
| CORRECTION COEFFICIENT (%) | {k(E) + k(F) + k(G) + k(H) + k(I) + k(J)}/6 | {k(E) + k(F) + k(G) + k(H) + k(I)}/5 |

IMAGE RECORDING APPARATUS

CROSS REFERENCE TO RELATED APPLICATION

The present application claims priority from Japanese Patent Application No. 2010-119852, filed on May 25, 2010, the disclosure of which is incorporated herein by reference in its entirety.

BACKGROUND OF THE INVENTION

1. Field of the Invention

The present invention relates to an image recording apparatus which records an image on a recording medium transported by a transport section. In particular, the present invention relates to the setting of the transport amount in relation to the transport section during the recording.

2. Description of the Related Art

Conventionally, an image recording apparatus, which is exemplified, for example, by a printer, a copying machine, and a facsimile, transports a recording medium such that the recording medium is interposed or nipped by a transport roller pair composed of a transport roller which uses a driving motor as a driving source and a driven roller which is arranged opposingly to the transport roller. The recording medium, which is transported by the transport roller pair, is transported to a recording section, and an image is recorded on the recording medium by the recording section.

Incidentally, in recent years, it is demanded for the image recording apparatus that the image is recorded in a higher quality. In order to perform the high quality image recording, it is demanded to improve the transport accuracy of the recording medium transported by the transport roller pair. In view of the above, Japanese Patent Application Laid-open No. 2000-6478 discloses a paper feed control method including measuring, for each of types of recording paper, a relationship between a recording paper feed amount brought about by a transport roller which is pressed by a driven roller and a rotation amount of a driving motor which drives the transport roller, selecting a correction value of the rotation amount of the driving motor for each of the types of the recording paper based on the measured data, and controlling the rotation amount of the driving motor by using the selected correction value. In this way, the transport amount is set differently depending on each of the types of the recording paper.

However, the interposing force or nipping force of the transport roller pair, which is exerted on the recording medium, is not constant in some cases in the direction perpendicular to the transport direction of the transport roller pair. In the case of the paper feed control method described in Japanese Patent Application Laid-open No. 2000-6478, the transport amount is set depending on each of the types of the recording paper, but the transport amount is not set for recordings when the positions differ in the direction perpendicular to the transport direction of the recording papers transported by the transport roller pair. Therefore, the transport accuracy is consequently lowered depending on the positions of the recording mediums in the direction perpendicular to the transport direction. It is impossible to record the image at a high quality in some cases.

SUMMARY OF THE INVENTION

The present invention has been made taking the foregoing problem into consideration, an object of which is to provide an image recording apparatus which makes it possible to improve the transport accuracy and realize the recording of an image at a high quality by determining a rotation amount of a driving roller for constructing a transport roller pair depending on a position of a recording medium in a direction perpendicular to a transport direction.

According to an aspect of the present invention, there is provided an image recording apparatus which records an image on a recording medium, the image recording apparatus including: at least one roller pair which includes a driving roller to which a driving force is transmitted from a driving source and a driven roller arranged to face the driving roller and which rotates in a state of interposing the recording medium therebetween to transport the recording medium in a first direction; a recording section which records the image on the recording medium transported by the roller pair; a position detecting section which detects a position of the recording medium with respect to the roller pair in a second direction perpendicular to the first direction before the recording section starts recording of the image; a determining section which determines a rotation amount of the driving roller before the recording section starts the recording of the image depending on the position in the second direction of the recording medium detected by the position detecting section; and a control unit which controls the driving roller based on the rotation amount determined by the determining section so that the roller pair transports the recording medium.

According to the aspect of the present invention, the rotation amount of the driving roller is determined depending on the position of the recording medium in the second direction. Therefore, the recording medium can be transported by using the appropriate rotation amount of the driving roller irrelevant to the position of the recording medium. Therefore, an effect is obtained such that the transport accuracy is improved and the image quality is improved.

BRIEF DESCRIPTION OF THE DRAWINGS

FIGS. 20A and 20B show tables illustrating examples of the rotation amount table stored in a rotation amount table memory.

FIGS. 21A to 21C show tables illustrating examples of the hysteresis rotation amount table stored in a hysteresis rotation amount table memory in relation to respective recording paper sheet positions and oblique transport amounts of the respective recording paper sheets.

FIGS. 22A to 22G show tables illustrating the correction coefficient stored in ROM in a modified embodiment of the embodiment of the present invention and tables illustrating the average or mean correction coefficient stored temporarily in RAM and calculated when the correction coefficient is used.

DESCRIPTION OF THE PREFERRED EMBODIMENTS

Figure 1:
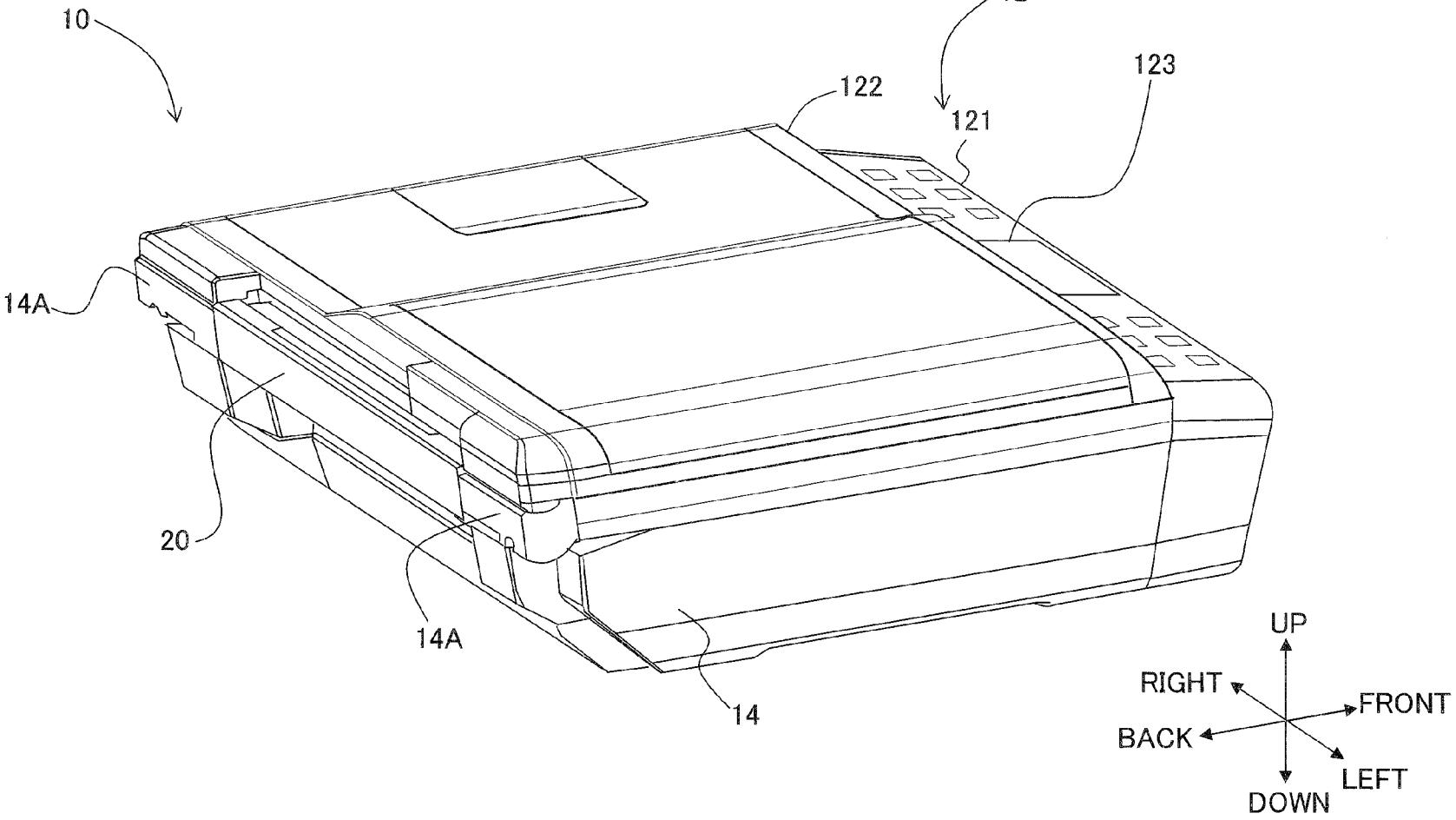
FIG. 1 shows a perspective view illustrating an external structure of a multifunction machine according to an embodiment of the present invention.

Preferred embodiments of the present invention will be explained appropriately below with reference to the drawings. It is noted that the embodiments explained below are merely examples of the present invention. It goes without saying that the embodiments of the present invention can be appropriately changed within a range without changing the gist or essential characteristics of the present invention.

An explanation will be made with reference to FIG. 1 about a structure or arrangement of a multifunction machine 10 as an example of the image recording apparatus according to an embodiment of the present invention. In the following explanation, the upward-downward direction is defined based on a state (state shown in FIG. 1) in which the multifunction machine 10 is installed usably. The front-back direction (example of the first direction of the present invention) is defined assuming that the side, on which an operation panel 121 is provided, is the front side (front surface). The left-right direction (example of the second direction of the present invention) is defined assuming that the multifunction machine 10 is viewed from the front side (front surface).

An image reading section 12 is provided at an upper portion of the multifunction machine 10, the operation panel 121 is provided on the frontward side of the upper surface, and a printer section 11 (see FIG. 2), which is based on the ink-jet recording system, is provided at a lower portion. The multifunction machine 10 has various functions including, for example, the facsimile function, the printer function, the scanner function, and the copy function.

The image reading section 12 is arranged at the upper portion of the printer section 11, and the image reading section 12 is provided with a scanner section 122. The scanner section 122 is constructed as a flat bed scanner (FBS) and an automatic document feeder (ADF). However, in the present invention, the scanner section 122 is constructed arbitrarily provided that an image, which is recorded on a manuscript, is read. Therefore, any detail explanation thereof is omitted in this specification.

The operation panel 121 is provided on the frontward side of the upper surface of the multifunction machine 10 at the upper portion on the front surface side of the scanner section 122 for an operator to operate the printer section 11 and the scanner section 122. The operation panel 121 is composed of various operation buttons and a liquid crystal display section 123. The multifunction machine 10 is operated in accordance with the instruction inputted from the operation panel 121. For example, the size of the recording paper P to be used for the recording is instructed by operating the operation panel 121 by the operator.

Figure 2:
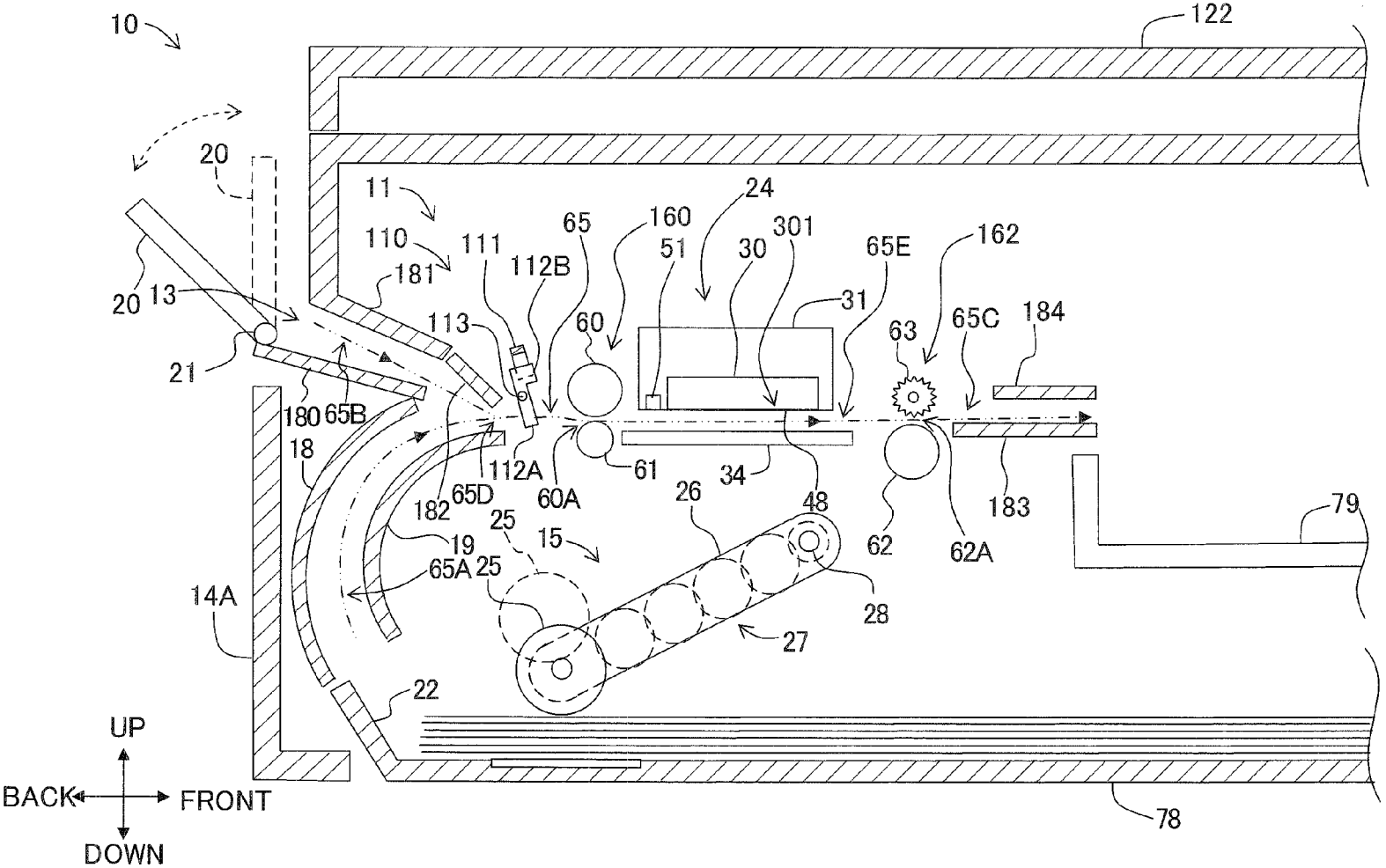
FIG. 2 shows a sectional view illustrating a structure of a printer section as viewed from the left depicted in FIG. 1.

As shown in FIG. 1, the printer section 11 has a casing (housing) 14 which has openings formed on the front surface and the back surface. As shown in FIG. 2, respective constitutive components of the printer section 11 are arranged in the casing 14. An accommodating chamber is comparted so that the accommodating chamber is continuous from the front opening (not shown) of the printer section 11 to the inside of the casing 14. A paper feed cassette 78 is installed to the accommodating chamber. The paper feed cassette 78 is constructed so that the paper feed cassette 78 is insertable (installable) and removable in the front-back direction 8 with respect to the interior of the casing 14 from the front opening. The paper feed cassette 78 is capable of holding the sheets of the recording paper P having various sizes.

A manual feed tray 20 is arranged openably/closably at a height between those of the scanner section 122 and the paper feed cassette 78 on the back surface 14A of the printer section 11. As shown by dotted line arrows in FIG. 2, the manual feed tray 20 is opened/closed by rotating the manual feed tray 20 about the central axis of rotation of a base shaft 21. FIG. 1 shows a state in which the manual feed tray 20 is closed. As shown in FIG. 2, the sheets of the recording paper P having various sizes can be placed on the manual feed tray 20 in a state in which the manual feed tray 20 is open. A back opening 13 is provided at a position opposed to the proximal end portion (end portion disposed on the lower side) of the manual feed tray 20 on the back surface 14A of the printer section 11. The recording paper P is inserted by the operator toward the front from the back opening 13 while being carried by the recording paper placing surface of the manual feed tray 20.

Next, the arrangement of the printer section 11 will be explained in more detail with reference to FIGS. 2, 3, and 4. In FIG. 2, the portion of the paper feed cassette 78, which is disposed on the front side (right side on the paper surface), is omitted from the illustration. The printer section 11 includes, for example, a feed section 15 which picks up and feeds (supplies) the recording paper P from the paper feed cassette 78 and a recording section 24 based on the ink-jet recording system which discharges ink droplets onto the recording paper P fed by the feed section 15 to form an image on the recording paper P, in addition to the paper feed cassette 78. As shown in FIG. 2, the transport passage 65, which ranges from the paper feed cassette 78 and the manual feed tray 20 via the recording section 24 to arrive at a discharged paper holding section 79, is formed in the printer section 11. The transport passage 65 is comparted into a curved passage 65A, a transport route 65B, a paper discharge passage 65C, and a recording route 65E.

The curved passage 65A is formed in a range ranging from the forward end (end portion on the backward side) of the paper feed cassette 78 to arrive at a nip position 60A as the position at which driven runners 61 abut against (are brought into contact with) a transport roller 60 for constructing a transport roller pair 160. In other words, the curved passage 60A is a curved passage provided to extend from the vicinity of the upper end of a separating inclined plate 22 provided for the paper feed cassette 78 to the nip position 60A. The recording paper P is transported backwardly from the paper feed cassette 78. The recording paper P is subjected to a U-turn from the lower position to the upper position of the apparatus by means of the curved passage 65A on the back surface side of the apparatus. After that, the recording paper P is transported frontwardly. The curved passage 65A is comparted by an outer guide member 18 and an inner guide member 19 which are opposed to one another while being separated from each other by a predetermined spacing distance. Each of the outer guide member 18 and the inner guide member 19 as well as each of a first lower guide member 180, a first upper guide member 181, a second upper guide member 182, a second lower guide member 183, and a third upper guide member 184 described later on extends in the direction (left-right direction shown in FIG. 1) perpendicular to the paper surface of FIG. 2.

The transport route 65B is formed in a range ranging from the forward end (end portion on the frontward side) of the manual feed tray 20 to arrive at a merging point 65D to merge with the curved passage 65A. In other words, the transport route 65B is a straight line-shaped passage provided to extend from the back opening 13 of the printer 11 to the merging point 65D to merge with the curved passage 65A. The recording paper P is inserted via the back opening 13 and the transport route 65B so that the recording paper P abuts against (is brought into contact with) the transport roller 60 and the driven runners 61 at the nip position 60A. The transport route 65B is comparted by the first lower guide member 180 and the first upper guide member 181 which are opposed to one another while being separated from each other by a predetermined spacing distance. The second upper guide member 182 is provided on the front side in the front-back direction of the first upper guide member 181. The second upper guide member 182 is provided to extend so that the second upper guide member 182 connects the forward end (end portion on the frontward side) of the first upper guide member 181 and the vicinity of the upper portion of the merging point 65D. The recording paper P, which is inserted from the manual feed tray 20, is guided thereby via the merging point 65D to the nip position 60A. In this embodiment, the first lower guide member 180 and the outer guide member 18 are formed distinctly or individually. However, the both may be formed integrally. Further, the first upper guide member 181 and the second upper guide member 182 are formed distinctly or individually. However, the both may be formed integrally.

The paper discharge passage 65C is formed in a range ranging from a nip position 62A as the position at which spurs 63 abut against (are brought into contact with) a paper discharge roller 62 which constructs a paper discharge roller pair 162 to arrive at the discharged paper holding section 79. In other words, the paper discharge passage 65C is comparted by the second lower guide member 183 and the third upper guide member 184 which are provided on the frontward side as compared with the recording section 24. The paper discharge passage 65C guides the recording paper P toward the frontward side while supporting the lower surface of the recording paper P having the image recorded by the recording section 24 and which is transported by the paper discharge roller 62. The third upper guide member 184 is arranged upwardly as compared with the second lower guide member 183. The third upper guide member 184 and the second lower guide member 183 are arranged so that they are opposed to one another while being separated from each other by a predetermined spacing distance through which the recording paper P can pass.

The recording route 65E is formed in a range ranging from the nip position 60A via the recording section 24 to arrive at the nip position 62A. In other words, the recording route 65E is comparted by the route ranging from the nip position 60A which is disposed between the transport roller 60 and the driven runners 61 via the space which is provided between the lower surface of a carriage 31 and a platen 34 arranged under or below the carriage 31 to arrive at the nip position 63A which is disposed between the paper discharge roller 62 and the spurs 63. In the recording route 65E, the operation is performed to form the image by the recording section 24 on the recording paper P transported to the recording section 24.

The feed section 15 is provided to transport the recording paper P accommodated in the paper feed cassette 78 toward the curved passage 65A. A paper feed roller 25 is arranged on the upper side of the paper feed cassette 78. The paper feed roller 25 picks up the recording paper P accommodated in the paper feed cassette 78 so that the recording paper P is fed to the curved passage 65A. The paper feed roller 25 is rotatably supported at the forward end of a paper feed arm 26. The paper feed roller 25 is driven and rotated when the rotational force of a paper feed motor 71 (see FIG. 5) is transmitted via a paper feed driving transmitting mechanism 27. The paper feed driving transmitting mechanism 27 is rotatably supported by the paper feed arm 26. The paper feed driving transmitting mechanism 27 is composed of a plurality of gears which are aligned in a straight line form approximately in the extending direction of the paper feed arm 26. The paper feed roller 25 is rotated about the rotational central axis of a base shaft 28. The paper feed roller 25 can be brought in contact under pressure with the upper surface of the recording paper P accommodated in the paper feed cassette 78.

The curved passage 65A is provided with a registration sensor 110 in order to sense or detect the end or the presence or absence of the recording paper P which is fed from the paper feed cassette 78 and which is transported through the curved passage 65A or the recording paper P which is inserted from the manual feed tray 20 via the transport route 65B. The registration sensor 110 is composed of, for example, a rotatable member which has a first detecting element 112A and a second detecting element 112B, and an optical sensor 111 such as a photointerrupter or the like which has a light-emitting element (for example, a light emitting diode) and a light-receiving element (for example, a phototransistor) for receiving the light emitted from the light-emitting element. The rotatable member is provided rotatably about the center of a support shaft 113. The first detecting element 112A protrudes from the support shaft 113 toward the curved passage 65A. In a state in which any external force is not applied to the first detecting element 112A, the second detecting element 112B enters the optical path for the optical sensor 111 ranging from the light-emitting element to the light-receiving element, and the second detecting element 112B blocks the light which would be otherwise allowed to pass through the optical path.

As described above, the rotatable member has the first detecting element 112A protruding toward the curved passage 65A. Therefore, when the external force is applied, for example, such that the recording paper P abuts against the first detecting element 112A, then the rotatable member 112 receives the pressing force from the recording paper P, and the rotatable member 112 is rotated counterclockwise as viewed in FIG. 2 about the center of the support shaft 113. The second detecting element 112B is also rotated in accordance with the rotary action of the first detecting element 112A. Accordingly, the second detecting element 112B is retracted from the optical path of the optical sensor 111. Therefore, the light, which is emitted from the light-emitting element, passes through the optical path, and the light is received by the light-receiving element. In this situation, the output signal, which is outputted from the light-receiving element of the optical sensor 111, is fluctuated. Specifically, the signal level of the output signal is changed from LOW to HIGH. The control unit 90 (see FIG. 5) detects the presence or absence of the recording paper P passing through the curved passage 65A based on the fluctuation.

The recording section 24 (example of the recording section of the present invention) is provided with the carriage 31 which carries a recording head 30 and which is reciprocatively movable in the left-right direction (direction perpendicular to the paper surface of FIG. 2). The recording head 30 is exposed on the lower side of the carriage 31, to which respective color inks of cyan (C), magenta (M), yellow (Y), and black (Bk) are supplied from ink tanks 32 (see FIG. 3) via ink tubes 33 (see FIG. 3).

With reference to FIG. 2, a plurality of nozzles 301 are formed on the lower surface of the recording head 30. The nozzles 301, which correspond to each of the color inks, are aligned in one array in the front-back direction. The respective arrays of the nozzles 301 corresponding to the respective color inks are aligned in the left-right direction (direction perpendicular to the paper surface of FIG. 2) which is the direction of reciprocative movement of the carriage 31.

The recording head 30 discharges the respective inks as minute ink droplets from the nozzles 301 provided on the lower surface thereof. When the carriage 31 is reciprocatively moved in the left-right direction, then the recording head 30 is scanned across the recording paper P, and the image is recorded on the recording paper P transported on the platen 34.

Figure 3:
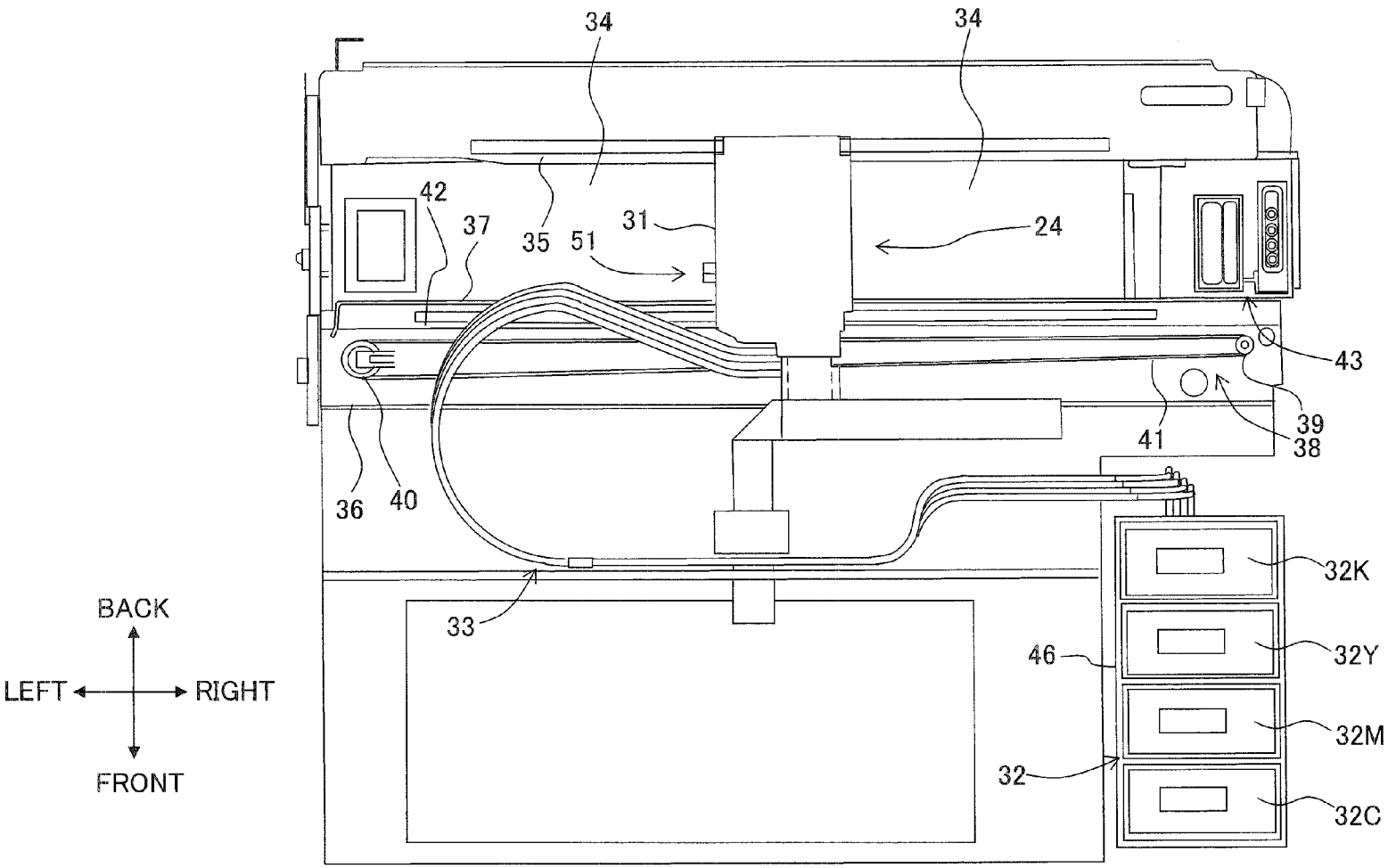
FIG. 3 shows a sectional view illustrating the structure of the printer section as viewed from the upward depicted in FIG. 1.
Figure 4:
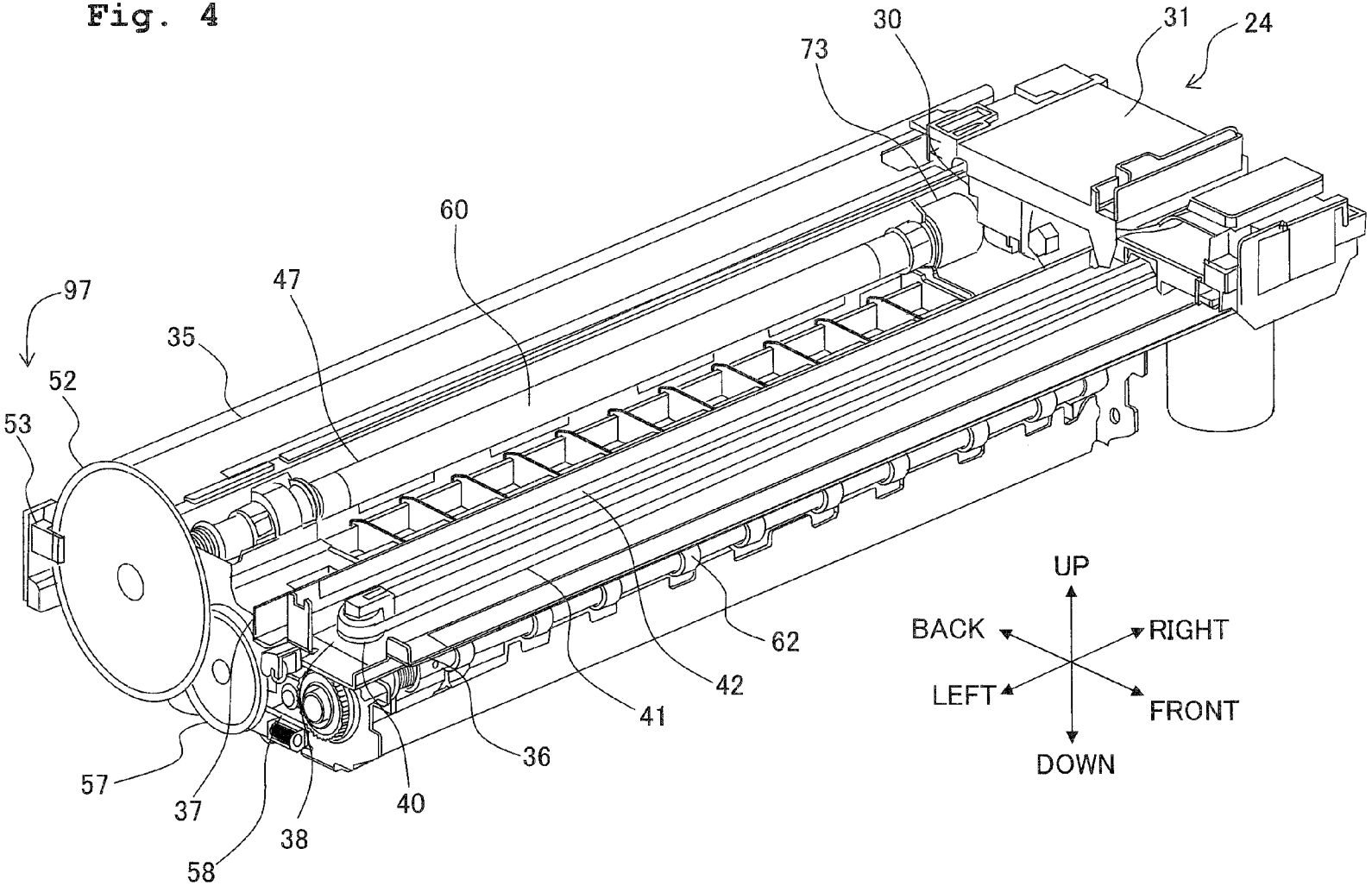
FIG. 4 shows a perspective view illustrating a structure of a recording section of the printer section.

As shown in FIGS. 3 and 4, a pair of flat plate-shaped guide rails 35, 36 are arranged on the upper side of the recording route 65E arranged with the recording section 24. The guide rails 35, 36 are provided to extend in the widthwise direction (left-right direction) of the recording route 65E while being separated from each other in the front-back direction of the recording paper P. The carriage 31 is provided to span the guide rails 35, 36 so that the carriage 31 is slidable in the left-right direction on the guide rails 35, 36.

A belt driving mechanism 38 is arranged on the upper surface of the guide rail 36. The belt driving mechanism 38 is composed of an endless annular timing belt 41 which has teeth provided on the inner side and which is stretched between a driving pulley 39 and a driven pulley 40 provided in the vicinity of the both ends of the recording route 65E in the widthwise direction (left-right direction) respectively. A carriage motor 75 (see FIG. 5) is connected to the shaft of the driving pulley 39, and the driving force is inputted from the carriage motor 75. The timing belt 41 performs the rounding motion in accordance with the rotation of the driving pulley 39. The timing belt 41 is not limited to one having the endless annular shape. Other than the above, it is also appropriate to use such a timing belt that both end portions of an open end belt are secured to the carriage 31.

The timing belt 41 is secured to the carriage 31. The carriage 31 is reciprocatively moved on the guide rails 35, 36 on the basis of the end portion 37 in accordance with the rounding motion of the timing belt 41. The recording head 30 is carried on the carriage 31. Therefore, the recording head 30 is reciprocatively movable in the widthwise direction (left-right direction) of the recording route 65E together with the carriage 31. An encoder strip 42 of a linear encoder 99 (see FIG. 5) is arranged for the guide rail 36 along the end portion 37. The linear encoder 99 detects the encoder strip 42 by means of a photointerrupter (not shown). The reciprocative movement of the carriage 31 is controlled based on the detection signal of the linear encoder 62.

As shown in FIGS. 2 to 4, the platen 34 is arranged to face the recording head 30 under or below the recording route 65E. The platen 34 is arranged over a central portion of the reciprocative movement range of the carriage 30 through which the recording paper P is allowed to pass. The width of the platen 34 is sufficiently larger than the maximum width of the recording paper P capable of being transported. The both ends of the recording paper P are always allowed to pass over the platen 34.

As shown in FIG. 2, the recording route 65E has the transport roller pair 160 (example of the roller pair and the first roller pair of the present invention) which is provided at the back of the recording section 24. The transport roller pair 160 is composed of the transport roller 60 (example of the driving roller of the present invention) and the driven runners 61 (example of the driven roller of the present invention) which are provided under or below the transport roller 60. The driven runner 61 is brought in contact under pressure with the roller surface of the transport roller 60 by means of an elastic member such as an unillustrated spring or the like. The recording paper P, which is transported through the curved passage 65A or the transport route 65B, is interposed or nipped by the transport roller 60 and the driven runners 61 so that the recording paper P is fed onto the platen 34. The recording route 65E has the paper discharge roller pair 162 (example of the roller pair and the second roller pair of the present invention) which is provided in front of the recording section 24. The paper discharge roller pair 162 is composed of the paper discharge roller 62 (example of the driving roller of the present invention) and the spurs 63 (example of the driven roller of the present invention) which are provided over or above the paper discharge roller 62. The spur 63 is brought in contact under pressure with the roller surface of the paper discharge roller 62 by means of the self-weight or an unillustrated spring or the like. The recording paper P, on which the recording has been completed, is interposed or nipped by the paper discharge roller 62 and the spurs 63 so that the recording paper P is transported frontwardly (to the discharged paper holding section 79). The paper discharge roller pair 162 nips the recording paper P by using the spurs 63. Therefore, the nipping force, which is exerted by the paper discharge roller pair 162, is relatively smaller than the nipping force which is exerted by the transport roller pair 160 in order to prevent the recording paper P from being traced by the spurs 63 as well.

The transport roller 60 and the paper discharge roller 62 are rotated by the rotary driving force which is transmitted from a transport motor 73 (example of the driving source of the present invention) via an unillustrated driving transmitting mechanism. The transport roller 60 and the paper discharge roller 62 are rotated in such directions that the recording paper P is transported frontwardly by means of the rotary driving force in one direction of the transport motor 73. The transport roller 60 and the paper discharge roller 62 are rotated in such directions that the recording paper P is transported backwardly by means of the rotary driving force in the other direction of the transport motor 73.

The recording of the image on the recording paper P is realized by alternately repeating the recording operation which is performed by discharging the inks from the recording head 30 while allowing the carriage 31 to move in the left-right direction and the line feed operation in which the recording paper P on the platen 34 is transported frontwardly by a predetermined amount by means of the transport roller pair 160 and the paper discharge roller pair 162.

As shown in FIG. 4, the transport roller 60 is driven and rotated by the driving force transmitted from the transport motor 73 connected to one end of the transport roller 60 in the axial direction (left-right direction). The paper discharge roller 62 is driven and rotated by the driving force transmitted from the transport roller 60 via an intermediate gear 57 and a belt 58. Therefore, the paper discharge roller 62 depends on the rotation of the transport roller 60. Therefore, when the rotation amount is determined, the attention is focused on the transport roller 60.

Figure 5:
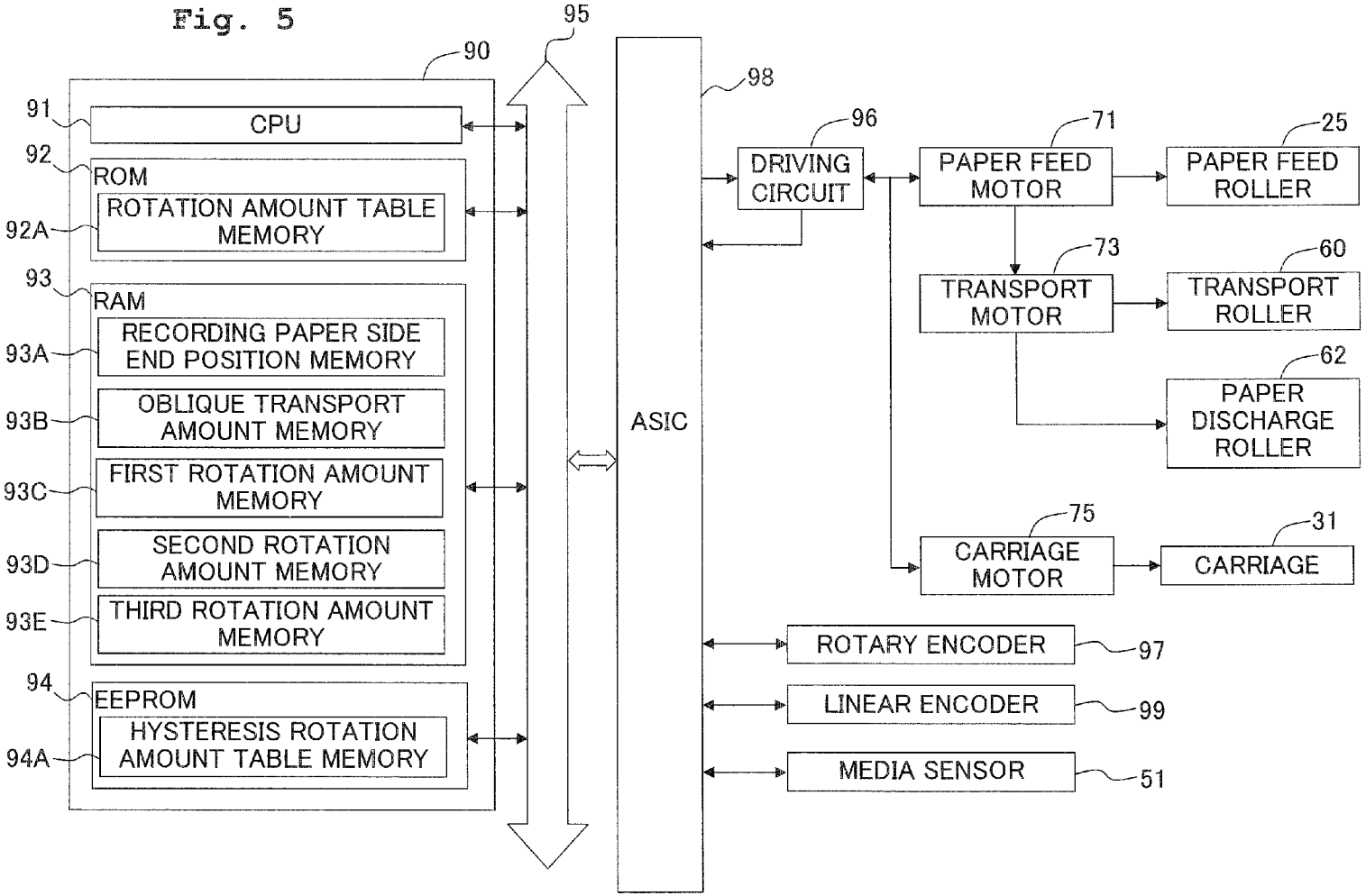
FIG. 5 shows a block diagram illustrating an arrangement of a control unit.

The transport roller 60 and the paper discharge roller 62 are controlled by a driving circuit incorporated into ASIC 98 (see FIG. 5). Accordingly, each of the directions of rotation thereof is switched into any one of the forward rotation and the reverse rotation. The direction of rotation is switched as described above by performing the switching control for the transport motor 73 or switching or changing, for example, the gear for transmitting the rotational force of the transport motor 73 to the rotary shaft of each of the rollers.

As shown in FIG. 4, a rotary encoder 97 (see FIG. 5) is composed of an encoder disk 52 and a photointerrupter 53. The encoder disk 52, which is provided at one end of the transport roller 60, has a plurality of slits which are provided in a radial line form. The slits are detected by the photointerrupter 53. The driving is controlled for the transport roller 60 and the paper discharge roller 62 on the basis of the detection signal of the photointerrupter 53. The position in the front-back direction of the recording paper P to be transported is calculated based on the detection signal of the photointerrupter 53 possessed by the rotary encoder 97.

Therefore, according to the calculated position in the front-back direction of the recording paper P, it is grasped or recognized whether the recording paper P is in a state in which the recording paper P is interposed by only the transport roller pair 160 (this state is hereinafter designated as "interposed state 1"), a state in which the recording paper P is interposed by the transport roller pair 160 and the paper discharge roller pair 162 (this state is hereinafter designated as "interposed state 2"), or a state in which the recording paper P is interposed by only the paper discharge roller pair 162 (this state is hereinafter designated as "interposed state 3").

A media sensor 51 (example of the first position detecting section or the oblique transport amount detecting section of the present invention), which is arranged at a back portion of the carriage 31, is composed of a light-emitting element which is, for example, a light emitting diode and a light-receiving element which is, for example, a phototransistor.

Figure 6:
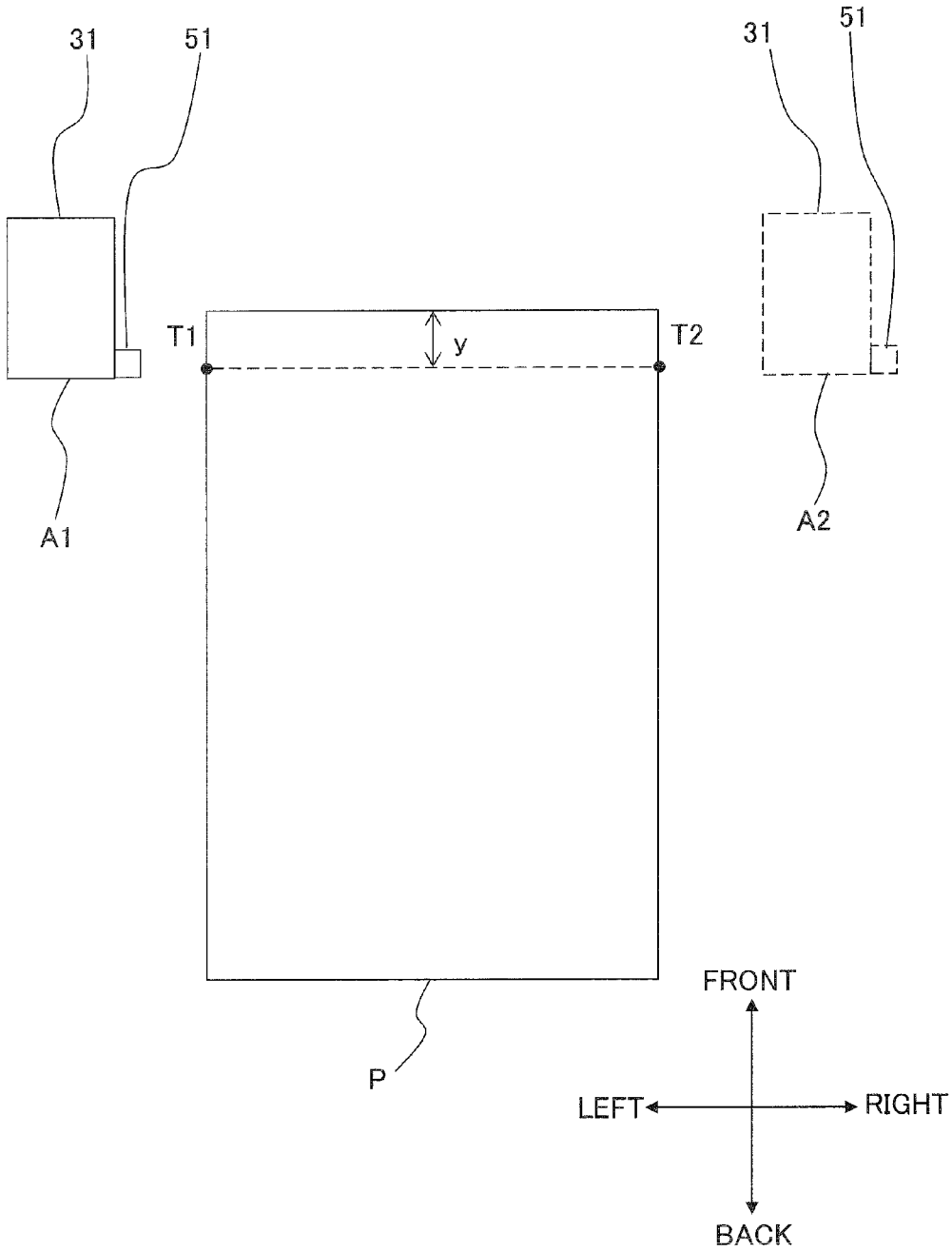
FIG. 6 schematically shows the reading of the recording paper by a media sensor.

An explanation will be made with reference to FIG. 6 about the detection of the side end positions of the recording paper P to be detected by the media sensor 51. In FIG. 6, the platen 34, the transport roller pair 160, and the paper discharge roller pair 162 are omitted in order to simplify the explanation.

The cueing operation is executed such that the portion, which is separated backwardly by y from the forward end of the recording paper P transported by the transport roller 60, is transported to the position disposed under the reading line of the media sensor 51 arranged on the carriage 31, and the transport roller 60 is stopped. The carriage 31, which has the media sensor 51, is moved from the position A1 to the position A2 while allowing the light-emitting element to emit the light. Accordingly, the media sensor 51 receives the reflected light from the upper surface of the platen 34 and the upper surface of the recording paper P by means of the light-receiving element.

For example, when the upper surface of the platen 34 has a color such as black or the like which has a low reflectance, the detected value of the light-receiving element, which is brought about by the reflected light from the recording paper P, is different from the detected value of the light-receiving element which is brought about by the reflected light from the platen 34. When the media sensor 51 passes along one side end T1 of the recording paper P, the detected value of the media sensor 51 is fluctuated from the value exhibited by the platen 34 to the value exhibited by the recording paper P. On the other hand, when the media sensor 51 passes along the other side end T2 of the recording paper P, the detected value of the media sensor 51 is fluctuated from the value exhibited by the recording paper P to the value exhibited by the platen 34. The positions of the both side ends of the recording paper P are detected in accordance with the fluctuation of the detected value. Further, the position of the carriage 31 is grasped or recognized by the encoder value indicated by the linear encoder 99. Therefore, when the point, at which the detected value of the media sensor 51 is fluctuated, is correlated with the encoder value indicated by the linear encoder 99 provided at that point in time, the position of the recording paper P in the left-right direction is calculated. The calculated side end positions of the recording paper P in the left-right direction are temporarily stored in a recording paper side end position memory 93A.

Figure 7:
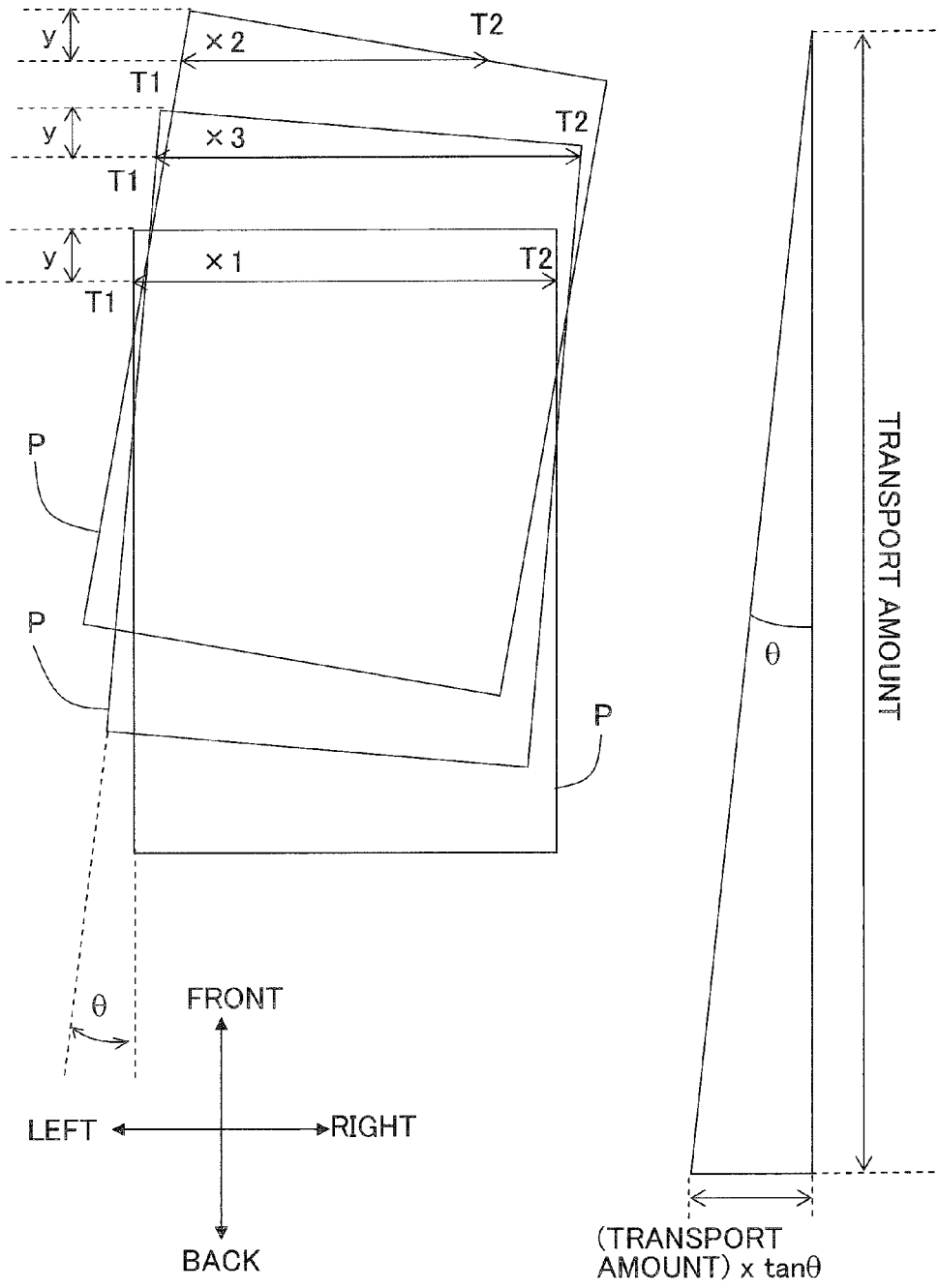
FIG. 7 schematically shows the change of the distance of the reading line provided when the recording paper travels obliquely by an inclination amount θ and the deviation amount in the left-right direction brought about by the transport.
Figure 8:
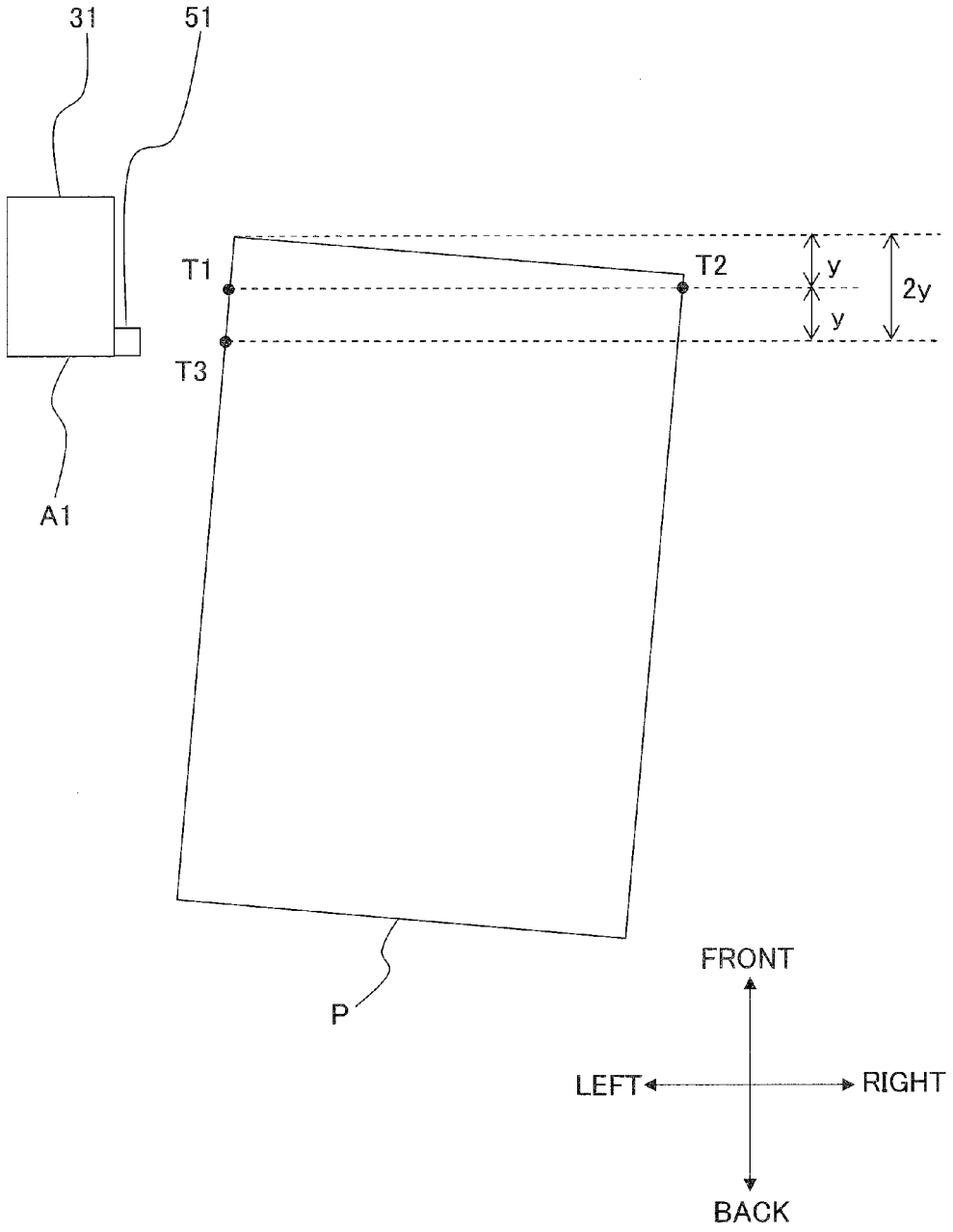
FIG. 8 schematically shows the reading by the media sensor performed when it is judged whether the forward end of the recording paper P is inclined to the left or the right in the left-right direction.

An explanation will now be made with reference to FIGS. 7 and 8 about the calculation of the oblique transport amount cos θ provided when the recording paper P is obliquely transported. θ is the amount of inclination of the recording paper P subjected to the oblique transport with respect to the recording paper P not subjected to the oblique transport. In other words, θ is the amount of inclination with respect to the front-back direction. When the recording paper P is transported obliquely, the position of the signal of the detected value indicated by the recording paper is changed as compared with the case in which the recording paper P is not transported obliquely. In other words, the distance X, which ranges from one side end T1 to the other side end T2, is changed at the cueing position separated backwardly by y from the forward end of the recording paper P. As shown in FIG. 7, when the distance x2 of the reading line, which is provided upon the oblique transport, is shorter than the distance x1 which is provided when the recording paper P is not transported obliquely ($x2<x1$), the reading cannot be achieved from one side end to the other side end of the recording paper P. In this case, the recording paper P travels extremely obliquely. Therefore, it is judged that the oblique transport amount $\cos\theta=x2/x1$ is outside a predetermined value. The recording paper P is forcibly discharged. As for the value of cos θ, the recording paper P is forcibly discharged in the case of the value indicated when the angle of θ is greater than 3 degrees to cause the inclination, i.e., $0.9986>\cos\theta$. It is judged whether or not the recording paper P is forcibly discharged depending on whether or not the distance of the reading line is smaller than x1. As described above, when the distance of the reading line is x2 which is shorter than x1, then it is judged that the oblique transport of the recording paper P is outside the predetermined value, and the recording paper P is forcibly discharged.

When the distance x3 of the reading line, which is provided upon the oblique transport, is greater than the distance x1 brought about when the recording paper P is not transported obliquely (x3>x1), then it is possible to represent the oblique transport amount cos θ=x3/x1, and the value of the oblique transport amount cos θ is calculated by CPU 91. As for the value of cos θ, in the case of the value exhibited when the angle of θ is not less than 0 degree and less than 1 degree to cause the inclination, i.e., 0.9998<cos θ≤1.0000, it is judged that the oblique transport is not caused.

Next, as for the value of cos θ, in the case of the value exhibited when the angle of θ is not less than 1 degree and less than 3 degrees to cause the inclination, i.e., 0.9986≤cos θ<0.9998, the deviation amount in the left-right direction is determined by the calculation by CPU 91, for the following reason. That is, if the recording paper P, which is subjected to the oblique transport, is transported, the abutment place, at which the recording paper P abuts against (is brought into contact with) the roller, is gradually deviated in the left-right direction. If the detected side end positions of the recording paper P are applied as they are, any change arises with respect to the actual abutment place in some cases. The specified values of 1 degree and 3 degrees are used as the angle θ described above. However, the values of the angle θ and the values of cos θ are merely examples. The value of the angle θ and the value of cos θ may be set within a range in which the transport is not affected even when the recording paper P obliquely travels, for example, in accordance with the size of the recording paper and the detection accuracy of the media sensor 51.

When the recording paper P is transported in a state in which the recording paper P obliquely travels, if the deviation amount in the left-right direction is determined, then it is firstly judged in which direction the recording paper P is obliquely transported. If it is judged that the recording paper P is obliquely transported, the recording paper P is transported so that the recording paper P is further separated frontwardly by y from the cueing position to perform the reading. In other words, the reading is performed at the portion separated backwardly by 2*y* from the forward end of the recording paper P. The carriage 31, which has the media sensor 51, starts the reading from the position A1 to detect one side end T3. Subsequently, the linear encoder values, which exhibit the positions of one side end T1 and one side end T3, are compared with each other. As shown in FIG. 8, one side end T3, which is disposed at the back of one side end T1, is positioned on the left side as compared with one side end T1. Therefore, the forward end of the recording paper P is subjected to the oblique transport rightwardly in relation to the frontward direction. It is judged that the abutment place, at which the recording paper P abuts against the roller pair, is deviated rightwardly in the left-right direction as the recording paper P is transported frontwardly. The recording paper P is transported backwardly by y to return the recording paper P to the curing position, and the reading of the recording paper P comes to an end.

After that, tan θ is determined by using the oblique transport amount cos θ, and tan θ is multiplied by a predetermined transport amount corresponding to one time of the line feed operation ((transport amount)×tan θ). Accordingly, it is possible to determine the extent of the deviation of the recording paper P in the left-right direction caused by the oblique transport with respect to the transport of the recording paper P in the front-back direction. Further, it is judged in which direction the recording paper P is inclined in the left-right direction by comparing the linear encoder values exhibited by one side end T1 and one side end T3 with each other. It is possible to determine the extent and the direction of the deviation of the recording paper P in the left-right direction on account of the oblique transport. Further, the determined oblique transport amount cos θ is temporarily stored in an oblique transport amount memory 93B of RAM 93, which is used to determine the rotation amount of the transport roller 60 when the recording paper P is transported.

Next, an explanation will be made with reference to FIG. 5 about the electrical arrangement of the multifunction mace 10. The control unit 90 controls the entire operation of the multifunction machine 10. However, any detailed explanation is omitted in relation to the control of the scanner section 12 and the recording section 24. In this embodiment, the control unit of the present invention is realized by the control unit 90.

The control unit 90 is arranged as a microcomputer principally comprising RAM 93 which is used as the data storage area or the working area and EEPROM 94 in which the setting information or the like is stored. The respective constitutive elements are connected to ASIC 98 via a bus 95.

CPU 91 (example of the determining section, the first to third determining sections, the judging section, the calculating section, and the comparing section of the present invention) controls the various functions possessed by the multifunction machine 10 and CPU 91 controls the respective components connected to ASIC 98 in accordance with predetermined values and programs stored in ROM 92 and RAM 93. Specifically, as described above, CPU 91 calculates the oblique transport amount cos θ. Further, CPU 91 calculates and specifies each of the roller pairs which interposes the recording paper P corresponding to the extent of the transport of the recording paper P and each of the driven runners 61 and the spurs 63 against which the recording paper P abuts corresponding to the extent of the transport of the recording paper P, based on the side end positions of the recording paper P and the oblique transport amount thereof. Further, CPU 91 arranges, in tables as shown in FIG. 21, the recording paper side end positions stored in RAM 93, the oblique transport amount cos θ, the first rotation amount (rotation amount in the interposed state 1), the second rotation amount (rotation amount in the interposed state 2), and the third rotation amount (rotation amount in the interposed state 3) which are stored thereby in a hysteresis rotation amount table memory 94A.

ROM 92 stores, for example, the programs for controlling the various operations of the multifunction machine 10. ROM 92 stores, for example, the various control programs including the programs for executing the processes shown by flow charts in FIGS. 16A to 19, and the data required to execute the control programs by CPU 91. The storage area of the rotation amount table memory 92A is allotted to ROM 92.

As shown in FIG. 20A, the rotation amount table, which exhibits the rotation amounts of the transport rollers 60 set depending on the position in the front-back direction and the position in the left-right direction in relation to the recording paper P, is stored in the rotation amount table memory 92A.

When the number of the driven runners 61 or the spurs 63 subjected to the abutment differs, for example, between the first sheet and the second sheet of the recording paper P depending on the position in the left-right direction and/or the position in the front-back direction of the recording paper P, the nip force is changed because of the difference in the number of nip points at which the force is received by the recording paper P from the roller pair. Further, for example, when the positions in the left-right direction, at which the recording paper P abuts against the driven runners 61 or the spurs 63, differ although the recording paper P abuts against the same number of the driven runners 61 or the spurs 63, the nip force is changed because of the difference in the positions of the nip points at which the force is received by the recording paper P from the roller pair.

Further, for example, the nip force is also changed when the interposing state of the roller pair for nipping the recording paper P differs in relation to one sheet of the recording paper P, for the following reason. That is, the nip force, which is exerted on the recording paper P by the transport roller pair 160, is different from the nip force which is exerted on the recording paper P by the paper discharge roller pair 162, or the nip force, which is received by the recording paper P, differs between the case in which the recording paper P is nipped by one roller pair and the case in which the recording paper P is nipped by two roller pairs.

When the nip force is changed, the force, which is transmitted from the roller pair to the recording paper P, is changed. Therefore, if the transport roller 60 is rotated in a constant rotation amount even when the position of the recording paper is changed, then the difference arises in the transport amount. Therefore, it is necessary that the rotation amount of the transport motor 73 should be set depending on the position of the recording paper P in the left-right direction and the position of the recording paper P in the front-back direction.

Specifically, the rotation amount table memory 92A stores the respective rotation amounts which are set depending on which driven runners 61 the recording paper P abuts against when the recording paper P is in the interposed state 1, which driven runners 61 and spurs 63 the recording paper P abuts against when the recording paper P is in the interposed state 2, and which spurs 63 the recording paper P abuts against when the recording paper P is in the interposed state 3. The respective rotation amounts are not identical with each other. Each of the rotation amounts represents the rotation amount (mm) of the transport roller 60 to be provided upon one time of the line feed operation.

RAM 93 is used as the working area and the storage area in which various pieces of the data, which are used when CPU 91 executes the various programs, are temporarily stored. The storage areas of the recording paper side end position memory 93A, the oblique transport amount memory 93B, the first rotation amount memory 93C, the second rotation amount memory 93D, and the third rotation amount memory 93E are allotted to RAM 93. The recording paper side end position memory 93A is the area which stores the side end positions in the left-right direction of the recording paper P in the recording route 65E. The oblique transport amount memory 93B is the area which stores the oblique transport amount cos θ when the recording paper P is transported obliquely. The first rotation amount memory 93C is the area which stores the rotation amount determined by the rotation amount calculating process as described later on when the recording paper P is in the interposed state 1. The second rotation amount memory 93D is the area which stores the rotation amount determined by the rotation amount calculating process as described later on when the recording paper P is in the interposed state 2. The third rotation amount memory 93E is the area which stores the rotation amount determined by the rotation amount calculating process as described later on when the recording paper P is in the interposed state 3.

For example, the setting and the flags, which should be retained even after the power source is turned OFF, are stored in EEPROM 94. The storage area of the hysteresis rotation amount table memory 94A is allotted to EEPROM 94. The hysteresis rotation amount table memory 94A stores the change or transition of the rotation amount set based on the oblique transport amount and the recording paper side end positions stored in the recording paper side end position memory 93A, the oblique transport amount memory 93B, the first rotation amount memory 93C, the second rotation amount memory 93D, and the third rotation amount memory 93E, as the hysteresis rotation amount tables shown in FIG. 21 based on the oblique transport amount and the recording paper side end positions by CPU 91.

A driving circuit 96 is connected to ASIC 98. The driving circuit 96 drives the paper feed motor 71 which is connected to the paper feed roller 25, the transport motor 73 which is connected to the transport roller 60 and the paper discharge roller 62, and the carriage motor 75 which is connected to the carriage 31. The driving circuit 96 is provided with respective drivers for driving the paper feed motor 71, the transport motor 73, and the carriage motor 75. The paper feed motor 71, the transport motor 73, and the carriage motor 75 are controlled independently by the respective drivers described above. Well-known transmitting mechanisms are provided so that the rotational force of the paper feed motor 71 is transmitted to the paper feed roller 25, the rotational force of the transport motor 73 is transmitted to the transport roller 60 and the paper discharge roller 62, and the rotational force of the carriage motor 75 is transmitted to the carriage 31.

In the multifunction machine 10 according to this embodiment, the transport motor 73 serves as the driving source for the transport roller 60 and the paper discharge roller 62 so that the recording paper P is transported toward the platen 34, and the recording paper P which is positioned on the platen 34 or the recording paper P on which the recording has been completed is transported toward the paper discharge tray 79.

For example, the media sensor 51, the rotary encoder 97 for detecting the rotation amount of the transport roller 60 driven by the transport motor 73, and the linear encoder 99 for detecting the scanning amount of the carriage 31 are connected to ASIC 98. The control unit 90 grasps or recognizes the transport amount of the recording paper P and the positions of the forward end and the side ends of the recording paper P in the recording route 65E and the paper discharge passage 65C based on the fluctuation of the output level of the output signal of the media sensor 51 and the encoder amounts detected by the rotary encoder 97 and the linear encoder 99.

Next, the operation of the multifunction machine 10 of this embodiment will be explained with reference to the top views of the recording route 65E shown in FIGS. 9A to 15, the flow charts shown in FIGS. 16A to 19, the rotation amount table shown in FIG. 20A, and the hysteresis rotation amount table shown in FIGS. 21A and 21B.

In this embodiment, an explanation will be made about the printing operation performed when the manual feed tray 20 is used. It goes without saying that the present invention is applicable to the printing operation performed when the paper feed cassette 78 is used. When the printing is performed by using the manual feed tray 20, the recording paper P is placed in a state in which the forward end thereof abuts against the nip position 60A. Therefore, the recording paper P is set to the transport route 65B including the merging point 65D. In this situation, the recording paper P is in a state of abutment against the rotatable member 112 of the registration sensor 110. After the setting, the recording paper P is transported to the recording route 65E by the transport roller 60, and the recording is performed thereon.

Figure 16A:
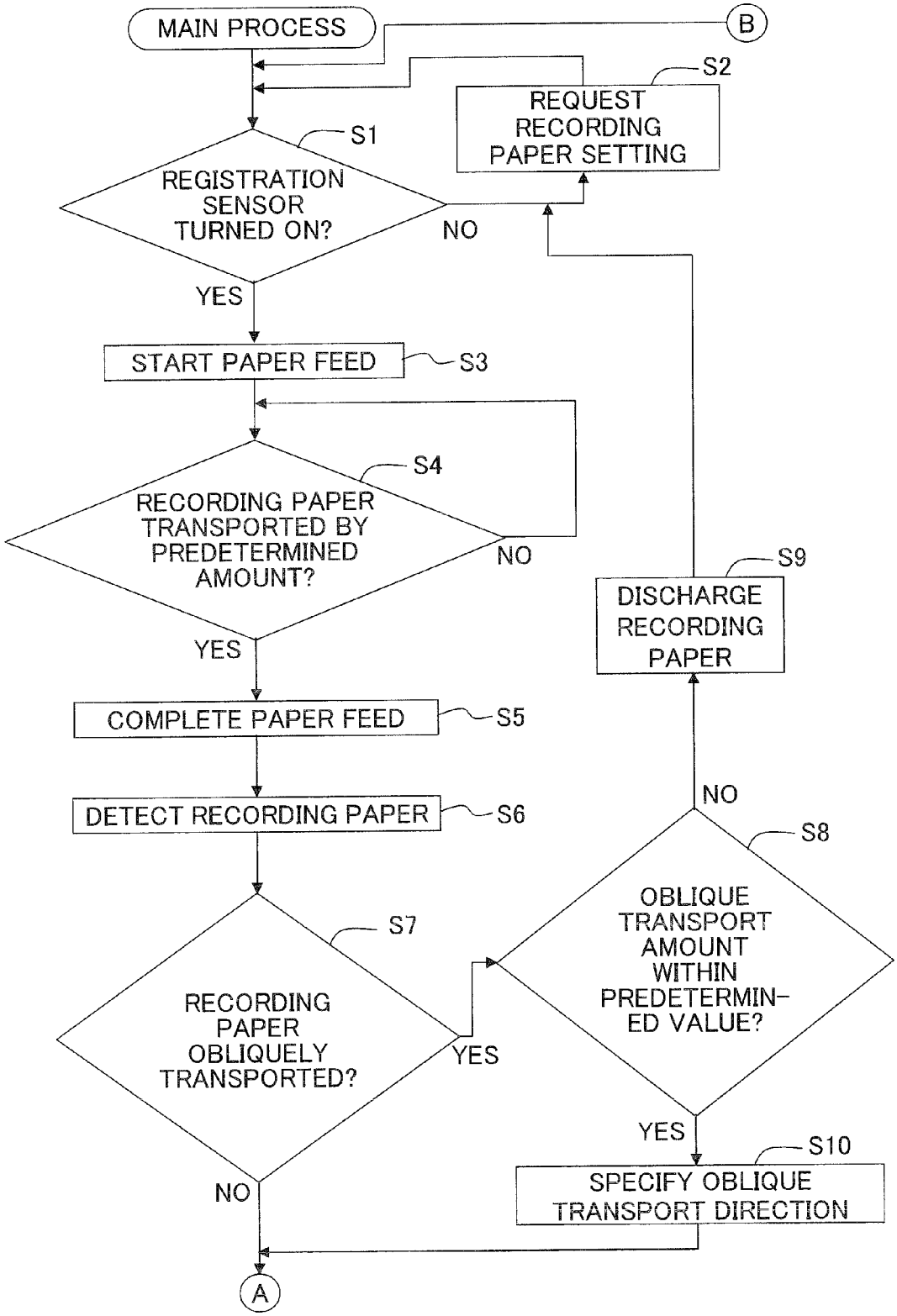
FIGS. 16A and 16B show a flow chart illustrating a main process to be executed by the control unit.
Figure 16B:
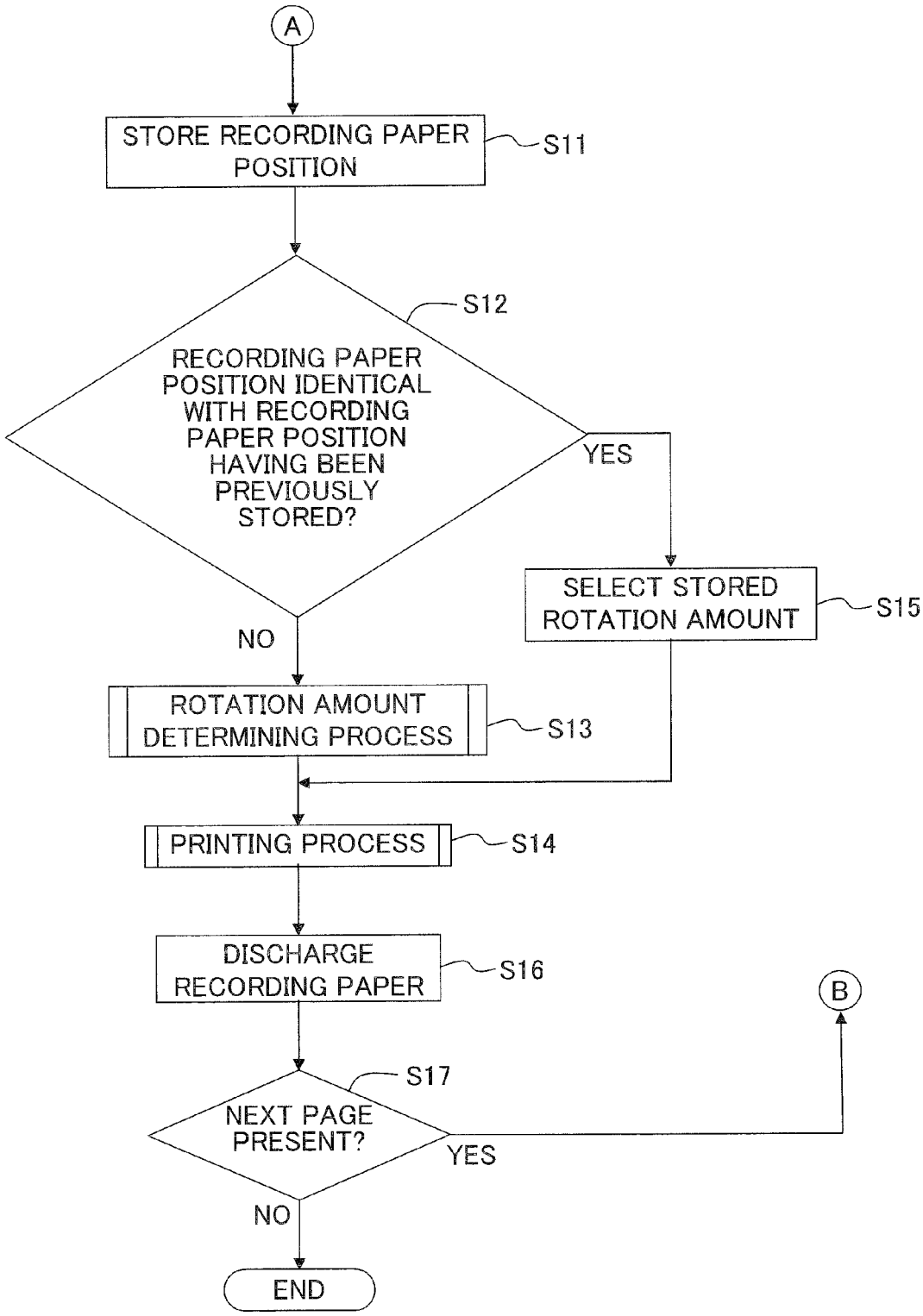

At first, an explanation will be made about the main process executed by CPU 91 of the multifunction machine 10 with reference to a flow chart shown in FIGS. 16A and 16B. The main process is the process executed when the manual feed printing function, which is included in the various functions such as the printer function, the scanner function, the copy function, the manual feed printing function and the like, is selected in accordance with the operation with the operation panel section 40 by the user. In particular, the main process includes such a process that the rotation amount of the transport roller 60 is appropriately determined depending on the interposed state of the recording paper P and the number or the positions of the driven runners 61 or the spurs 63 which abut against the recording paper P in the left-right direction, and the recording paper P is transported by using the determined rotation amount, when the recording paper P is deviated in the left-right direction or when the recording paper P is transported obliquely during the printing on the recording paper P.

In the main process, it is firstly confirmed whether or not the registration sensor is turned ON (Step 1, "Step" is hereinafter referred to as "S"). If the registration sensor is turned OFF (S1: NO), it is judged that the recording paper P is not set to display, on the liquid crystal display section 123, a message that the recording paper P should be correctly set (S2). If the registration sensor is turned ON (S1: YES), then it is judged that the recording paper P is set to the manual feed tray 20, and the forward end of the recording paper P is disposed at the nip position 60A of the transport roller pair 160. The transport roller 60 is rotated forwardly to start the paper feed to the recording route 65E (S3). Subsequently, it is judged whether or not the recording paper P is transported by a predetermined amount (S4). If the recording paper P is not transported by the predetermined amount (S4: NO), the paper feed operation is continued. If the recording paper P is transported by the predetermined amount (S4: YES) in accordance with the paper feed operation for the recording paper P by the transport roller 60, the rotation of the transport roller 60 is stopped (S5). The predetermined amount herein refers to the distance ranging from the nip position 60A to the cueing position at which the media sensor 51 can read the recording paper P. The predetermined amount is, for example, the distance obtained by transporting the recording paper P frontwardly by y from the forward end of the recording paper P shown in FIGS. 6, 7, and 8 described above.

Subsequently, the detection of the recording paper side end position and the detection of the oblique transport amount cos θ described above are executed by the media sensor 51 (S6). It is judged whether or not the recording paper is transported obliquely based on the oblique transport amount obtained by the detection in Step S6 (S7). If it is judged that the recording paper is not transported obliquely (S7: NO), specifically if it is judged that there is given the value exhibited when the recording paper P is inclined by the angle of θ as the value of the oblique transport amount cos θ which is not less than 0 degree and less than 1 degree, i.e., $0.9998<\cos\theta\leq1.0000$, then the recording paper side end position detected in Step S6 is stored in the recording paper side end position memory 93A, and the fact that the oblique transport amount is absent is stored in the oblique transport amount memory 93B. If it is judged that the recording paper P is transported obliquely (S7: YES), it is judged whether or not the detected oblique transport amount is within a predetermined value (S8). If the oblique transport amount is not within the predetermined value (S8: NO), specifically if it is judged there is given the value exhibited when the recording paper P is inclined by the angle of θ as the value of the oblique transport amount cos θ which is greater than 3 degrees, i.e., $\cos\theta<0.9986$, then the recording paper P is forcibly discharged as described above (S9), and the routine returns to Step S2 to display, on the liquid crystal display section 23, the message that the recording paper P should be correctly set (S2). If it is judged that the oblique transport amount is within the predetermined value (S8: YES), specifically if it is judged that there is given the value exhibited when the recording paper P is inclined by the angle of θ as the value of the oblique transport amount cos θ which is not less than 1 degree and less than 3 degrees, i.e., $0.9986<\cos\theta\leq0.9998$, then the recording paper P is further transported frontwardly by y, and the direction, in which the recording paper P is obliquely transported, is specified. If the direction is specified, then the transport roller is reversely rotated, and the recording paper P is transported backwardly by y (S10). After that, the recording paper side end position, which is detected in Step S6, is stored in the recording paper side end position memory 93A, and the oblique transport amount cos θ is stored in the oblique transport amount memory 93B (S11).

With reference to the recording paper side end position and the oblique transport amount included in the hysteresis rotation amount table memory 94A, it is judged whether or not the recording paper side end position and the oblique transport amount are identical with (equivalent to) the recording paper side end position and the oblique transport amount having been previously stored, as compared with those stored in Step S11 (S12). In this procedure, it is not necessarily indispensable that the detected recording paper side end position and the oblique transport amount should be identical with the recording paper side end position and the oblique transport amount having been previously stored. It is also allowable to regard that the former is the same as the latter even when the former recording paper side end position and the former oblique transport amount are slightly different from the latter recording paper side end position and the latter oblique transport amount as a result of the comparison. When the manual feed printing function of the multifunction machine 10 is firstly adopted, any previous data of the recording paper side end position and the oblique transport amount is absent in the hysteresis rotation amount table memory 94A. Therefore, it is judged that the recording paper position is not the same as that having been previously stored (S12: NO). If the recording paper side end position and the oblique transport amount, which are detected at present, are different from the recording paper side end position and the oblique transport amount which have been previously stored, it is also judged that the recording paper side end position and the oblique transport amount are not identical with the recording paper side end position and the oblique transport amount having been previously stored (S12: NO).

Subsequently, the rotation amount determining process is performed as described later on in order to determine the rotation amount which is changed with respect to the interposed state, the recording paper side end position, and the oblique transport amount (S13). The printing process is executed as described later on, in which the printing is performed by using the rotation amount determined in the rotation amount determining process in Step S13 (S14). When the printing process in Step S14 is completed, the recording paper, on which the recording has been finished, is discharged to the discharged paper holding section 79 (S16).

When the recording paper P is discharged, it is judged whether or not the printing data of the next page is present in the printing instruction (S15). If the printing data of the next page is present (S17: YES), the routine returns to Step S1. If the printing data of the next page is absent (S17: NO), the concerning main process comes to an end.

If it is judged in Step S12 that the recording paper side end position and the oblique transport amount, which have been previously stored, are identical with the recording paper side end position and the oblique transport amount which are calculated (S12: YES), the rotation amount, which is stored corresponding to the recording paper side end position and the oblique transport amount, is selected from the hysteresis rotation amount table memory 94A (S15). The selected transport parameters are stored in the first rotation amount memory 93C, the second rotation amount memory 93D, and the third rotation amount memory 93E respectively, and the routine proceeds to the printing process in Step S14.

An explanation will be made with reference to FIGS. 9A to 11B and a flow chart shown in FIG. 17 about details of the rotation amount determining process of the multifunction machine 10 (step S13 shown in FIG. 16B).

Figure 9B:
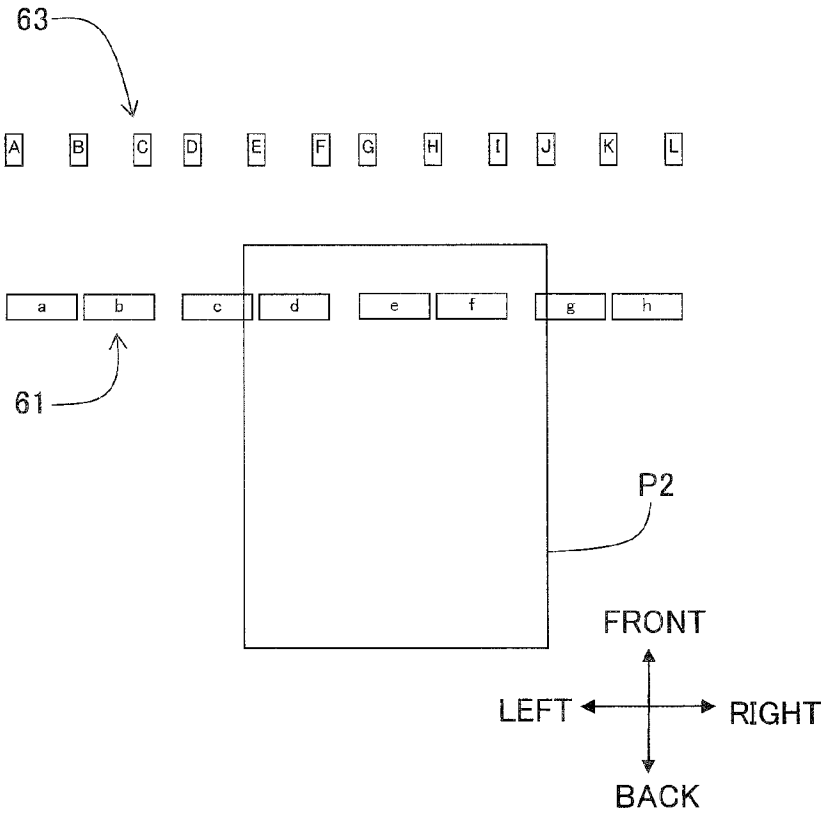
FIGS. 9A and 9B schematically show situations in which the recording paper sheets, which are not transported obliquely, are in the interposed state 1.
Figure 9A:
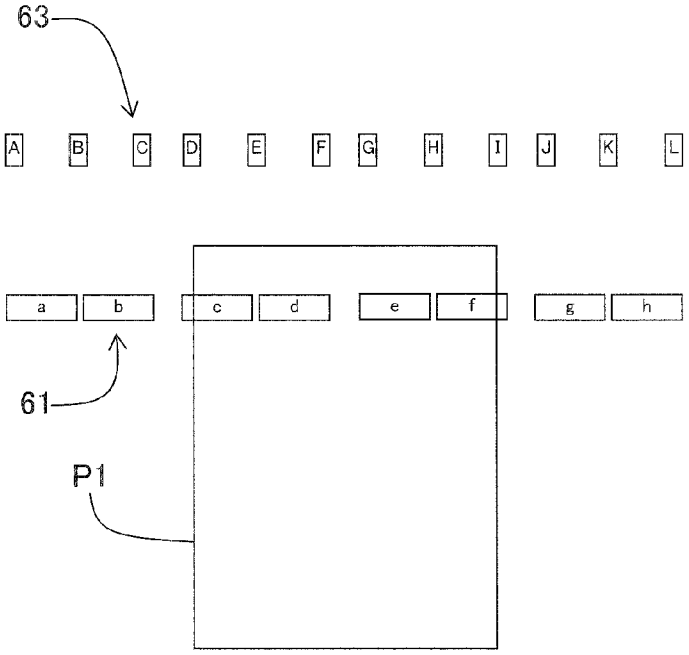

In FIGS. 9A to 11B, in order to simplify the explanation, the transport roller 60 and the paper discharge roller 62 are omitted from the respective drawings. The respective individual members of the driven runners 61 are designated as a, b, c, d, e, f, g, and h from the left in each of the drawings. The respective individual members of the spurs 63 are designated as A, B, C, D, E, F, G, H, I, J, K, and L from the left in each of the drawings. Broken lines shown in FIGS. 10A, 10B, 11A and 11B indicate the positions of the recording paper P1 and the recording paper P2 to which the recording paper P1 and the recording paper P2, which are depicted by solid lines in FIGS. 9A and 9B, are assumed to be transported thereafter.

At first, the driven runners 61, which are to be brought into contact with the recording paper P in the transport of the recording paper in the interposed state 1, are specified based on the recording paper side end positions stored in the recording paper side end position memory 93A (S101). In this case, the interposed state 1 is such a state that the recording paper P is interposed by only the transport roller pair 160, for example, as shown in FIGS. 9A and 9B.

In Step S101, the following method is available to specify the rollers. That is, the rollers or runners are specified by associating the recording paper side end positions T1, T2 stored in the recording paper side end position memory 93A with the arrangement positions of the driven runners 61. For example, when the recording paper P1 is positioned at the recording paper position as shown in FIG. 9A, the recording paper P1 is brought into contact with "c, d, e, f" of the driven runners 61. Therefore, the driven runners 61, which are brought into contact with the recording paper P1 in the interposed state 1, are specified to be "c, d, e, f" of the driven runners 61. On the other hand, for example, when the recording paper P2 is positioned at the recording paper position as shown in FIG. 9B, the recording paper P2 is brought into contact with "c, d, e, f, g" of the driven runners 61. Therefore, the driven runners 61, which are brought into contact with the recording paper P2 in the interposed state 1, are specified to be "c, d, e, f, g" of the driven runners 61.

The driven runners 61, with which the recording paper is brought into contact in the interposed state 1 and which are specified in Step S101, are associated with the rotation amount table shown in FIG. 20A stored in the rotation amount table memory 92A, and thus the first rotation amount, which is the rotation amount in the interposed state 1, is determined (S102). The driven runners 61, with which the recording paper P1 is brought into contact as shown in FIG. 9A, are specified to be "c, d, e, f" of the driven runners 61. Therefore, the first rotation amount in the interposed state 1 of the recording paper P1 is determined to be the rotation amount 1 based on FIG. 20A. On the other hand, the driven runners 61, with which the recording paper P2 is brought into contact as shown in FIG. 9B, are specified to be "c, d, e, f, g" of the driven runners 61. Therefore, the first rotation amount in the interposed state 1 of the recording paper P2 is determined to be the rotation amount 2 based on FIG. 20A.

The first rotation amount, which is determined in Step S102, is stored in the first rotation amount memory 93C (S103). That is, in the case of the recording paper P1 shown in FIG. 9A, the rotation amount 1 is stored in the first rotation amount memory 93C. In the case of the recording paper P2 shown in FIG. 9B, the rotation amount 2 is stored in the first rotation amount memory 93C.

Figure 10B:
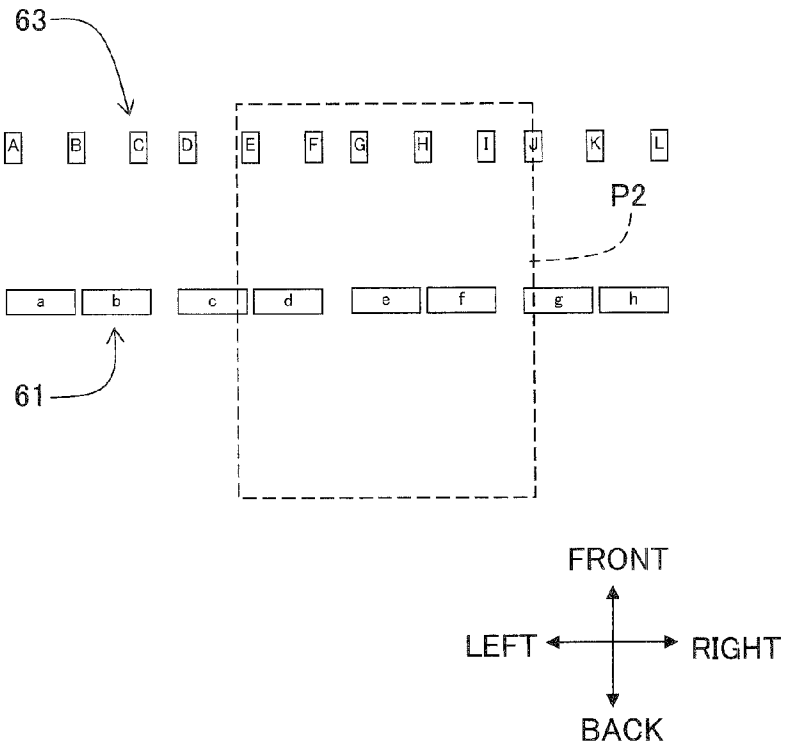
FIGS. 10A and 10B schematically show situations in which the recording paper sheets, which are not transported obliquely, are in the interposed state 2.
Figure 10A:
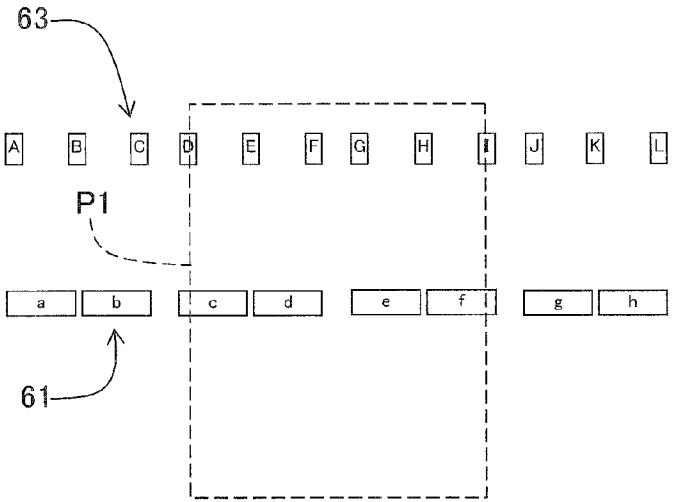

Subsequently, the driven runners 61 and the spurs 63, which are to be brought into contact with the recording paper P, are specified in the transport of the recording paper in the interposed state 2 based on the recording paper side end positions stored in the recording paper side end position memory 93A (S111). In this case, the interposed state 2 is such a state that the recording paper P is interposed by the transport roller pair 160 and the paper discharge roller pair 162, for example, as shown in FIGS. 10A and 10B.

In Step S111, the following method is available to specify the driven runners 61 and the spurs 63. That is, the driven runners 61 and the spurs 63 are specified by associating the recording paper side end positions T1, T2 stored in the recording paper side end position memory 93A with the arrangement positions of the driven runners 61 and the spurs 63. For example, when the recording paper P1 is positioned at the recording paper position as shown in FIG. 10A, the recording paper P1 is brought into contact with "c, d, e, f" of the driven runners 61 and "D, E, F, G, H, I" of the spurs 63. Therefore, the driven runners 61 and the spurs 63, which are brought into contact with the recording paper P1 in the interposed state 2, are specified to be "c, d, e, f" of the driven runners 61 and "D, E, F, G, H, I" of the spurs 63. On the other hand, for example, when the recording paper P2 is positioned at the recording paper position as shown in FIG. 10B, the recording paper P2 is brought into contact with "c, d, e, f, g" of the driven runners 61 and "E, F, G, H, I, J" of the spurs 63. Therefore, the driven runners 61 and the spurs 63, which are brought into contact with the recording paper P2 in the interposed state 2, are specified to be "c, d, e, f, g" of the driven runners 61 and "E, F, G, H, I, J" of the spurs 63.

The driven runners 61 and the spurs 63, with which the recording paper is brought into contact in the interposed state 2 and which are specified in Step S111, are associated with the rotation amount table shown in FIG. 20A stored in the rotation amount table memory 92A, and thus the second rotation amount, which is the rotation amount in the interposed state 2, is determined (S112). The driven runners 61 and the spurs 63, with which the recording paper P1 is brought into contact as shown in FIG. 10A, are specified to be "c, d, e, f" of the driven runners 61 and "D, E, F, G, H, I" of the spurs 63. Therefore, the second rotation amount in the interposed state 2 of the recording paper P1 is determined to be the rotation amount 4 based on FIG. 20A. On the other hand, the driven runners 61 and the spurs 63, with which the recording paper P2 is brought into contact as shown in FIG. 10B, are specified to be "c, d, e, f, g" of the driven runners 61 and "E, F, G, H, I, J" of the spurs 63. Therefore, the second rotation amount in the interposed state 2 of the recording paper P2 is determined to be the rotation amount 5 on the basis of FIG. 20A.

The second rotation amount, which is determined in Step S112, is stored in the second rotation amount memory 93D (S113). That is, in the case of the recording paper P1 shown in FIG. 10A, the rotation amount 4 is stored in the second rotation amount memory 93D. In the case of the recording paper P2 shown in FIG. 10B, the rotation amount 5 is stored in the second rotation amount memory 93D.

Figure 11B:
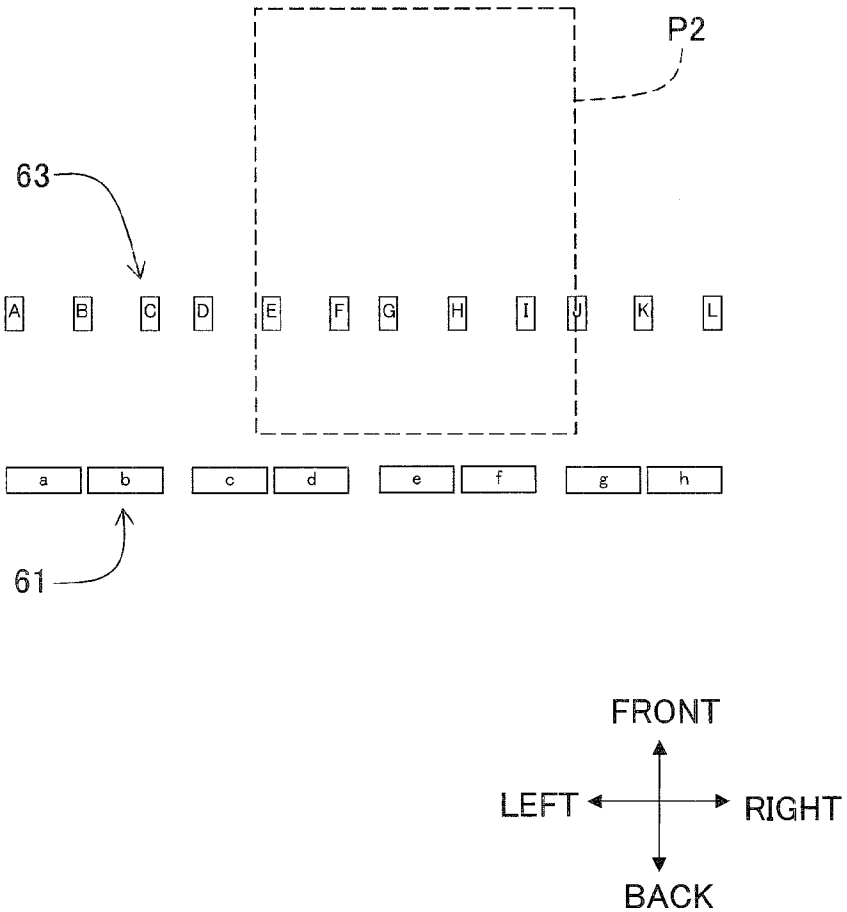
FIGS. 11A and 11B schematically show situations in which the recording paper sheets, which are not transported obliquely, are in the interposed state 3.
Figure 11A:
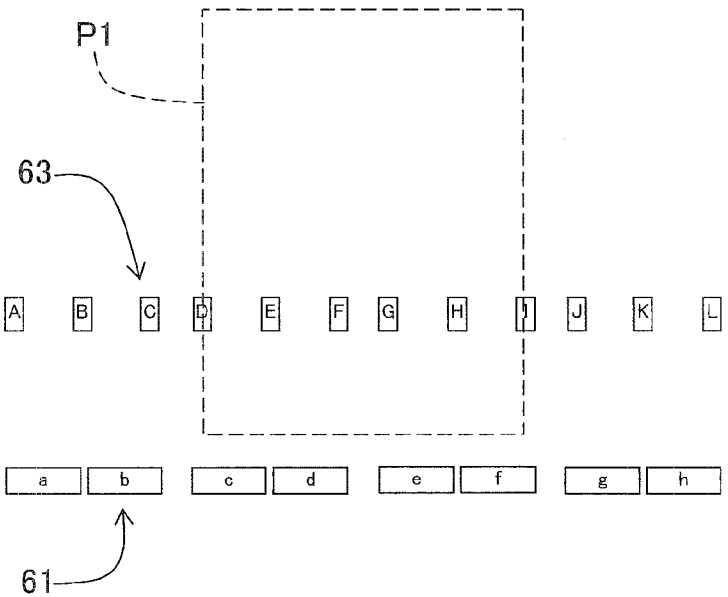

Subsequently, the spurs 63, which are to be brought into contact with the recording paper P, are specified in the transport of the recording paper in the interposed state 3 on the basis of the recording paper side end positions stored in the recording paper side end position memory 93A (S121). In this case, the interposed state 3 is such a state that the recording paper P is interposed by only the paper discharge roller pair 162, for example, as shown in FIGS. 11A and 11B.

In Step S121, the following method is available to specify the spurs 63. That is, the spurs 63 are specified by associating the recording paper side end positions T1, T2 stored in the recording paper side end position memory 93A with the arrangement positions of the spurs 63. For example, when the recording paper P1 is positioned at the recording paper position as shown in FIG. 11A, the recording paper P1 is brought into contact with "D, E, F, G, H, I" of the spurs 63. Therefore, the spurs 63 which are brought into contact with the recording paper P1 in the interposed state 3, are specified to be "D, E, F, G, H, I" of the spurs 63. On the other hand, for example, when the recording paper P2 is positioned at the recording paper position as shown in FIG. 11B, the recording paper P2 is brought into contact with "E, F, G, H, I, J" of the spurs 63. Therefore, the spurs 63, which are brought into contact with the recording paper P2 in the interposed state 3, are specified to be "E, F, G, H, I, J" of the spurs 63.

The spurs 63, with which the recording paper is brought into contact in the interposed state 3 and which are specified in Step S121, are associated with the rotation amount table shown in FIG. 20A stored in the rotation amount table memory 92A, and thus the third rotation amount, which is the rotation amount in the interposed state 3, is determined (S122). The spurs 63, with which the recording paper P1 is brought into contact as shown in FIG. 11A, are specified to be "D, E, F, G, H, I" of the spurs 63. Therefore, the third rotation amount in the interposed state 3 of the recording paper P1 is determined to be the rotation amount 8 based on FIG. 20A. On the other hand, the spurs 63, with which the recording paper P2 is brought into contact as shown in FIG. 11B, are specified to be "E, F, G, H, I, J" of the spurs 63. Therefore, the third rotation amount in the interposed state 3 of the recording paper P2 is determined to be the rotation amount 9 on the basis of FIG. 20A.

The third rotation amount, which is determined in Step S122, is stored in the third rotation amount memory 93E (S123). That is, in the case of the recording paper P1 shown in FIG. 11A, the rotation amount 8 is stored in the third rotation amount memory 93E. In the case of the recording paper P2 shown in FIG. 11B, the rotation amount 9 is stored in the third rotation amount memory 93E.

Subsequently, the recording paper side end positions stored in the recording paper side end position memory 93A, the first rotation amount stored in the first rotation amount memory 93C, the second rotation amount stored in the second rotation amount memory 93D, and the third rotation amount stored in the third rotation amount memory 93E are united and stored as the hysteresis rotation amount table in the hysteresis rotation amount table memory 94A as shown in FIGS. 21A to 21C (S130). The hysteresis rotation amount table is composed of the side end position of the recording paper as newly stored, the oblique transport amount at that time, and the rotation amount in each of the interposed states as determined on the basis of the side end position of the recording paper and the oblique transport amount. In the case of the recording paper P1 shown in FIGS. 9A, 10A, and 11A, FIG. 21A is prepared and stored. In the case of the recording paper P2 shown in FIGS. 9B, 10B, and 11B, FIG. 21B is prepared and stored. Thus, the concerning rotation amount determining process (Step S13 shown in FIG. 16B) comes to an end.

As described above, in this embodiment, the rotation amount of the transport roller 60 is set depending on the position in the left-right direction of the recording paper to be transported. The interposing force of the roller pair with respect to the recording paper is changed depending on the numbers and the positions of the driven runners 61 and the spurs 63 to be brought into contact with the recording paper. Therefore, when the position of the recording paper is different in the left-right direction, for example, between the recording paper P1 and the recording paper P2, then the interposing force of the roller pair with respect to the recording paper also differs, and the transport amount of the recording paper P is not constant. Therefore, in the present invention, the appropriate rotation amount of the transport roller 60 can be set depending on the position in the left-right direction of the recording paper, and hence it is possible to realize the accurate transport. Therefore, it is possible to improve the image quality.

As described above, in this embodiment, the setting is made such that the rotation amount is changed as the interposed state is changed in accordance with the transport of the recording paper. In the case of the position of the recording paper P1, as shown in FIG. 21A, the first rotation amount in the interposed state 1 is determined to be the rotation amount 1, the second rotation amount in the interposed state 2 is determined to be the rotation amount 4, and the third rotation amount in the interposed state 3 is determined to be the rotation amount 8. In the case of the position of the recording paper P2, as shown in FIG. 21B, the first rotation amount in the interposed state 1 is determined to be the rotation amount 2, the second rotation amount in the interposed state 2 is determined to be the rotation amount 5, and the third rotation amount in the interposed state 3 is determined to be the rotation amount 9. The interposing force of the roller pair with respect to the recording paper is also dispersed depending on the interposed state of the recording paper, and the transport amount of the recording paper P is not identical. Therefore, in the present invention, the appropriate rotation amount of the transport roller 60 is set depending on the interposed state of the recording paper, and hence it is possible to realize the accurate transport. Therefore, it is possible to improve the image quality.

As described above, in this embodiment, the rotation amount, which is determined in the rotation amount determining process on the basis of the side end positions of the recording paper, is stored in the hysteresis rotation amount table memory 94A. Accordingly, if the side end positions of the recording paper subjected to the reading are the same as the side end positions of the recording paper stored in the hysteresis rotation amount table memory 94A, it is possible to omit the process to be performed in the rotation amount determining process. Therefore, the processing speed is improved in the image recording, and thus the throughput is improved.

Figure 19:
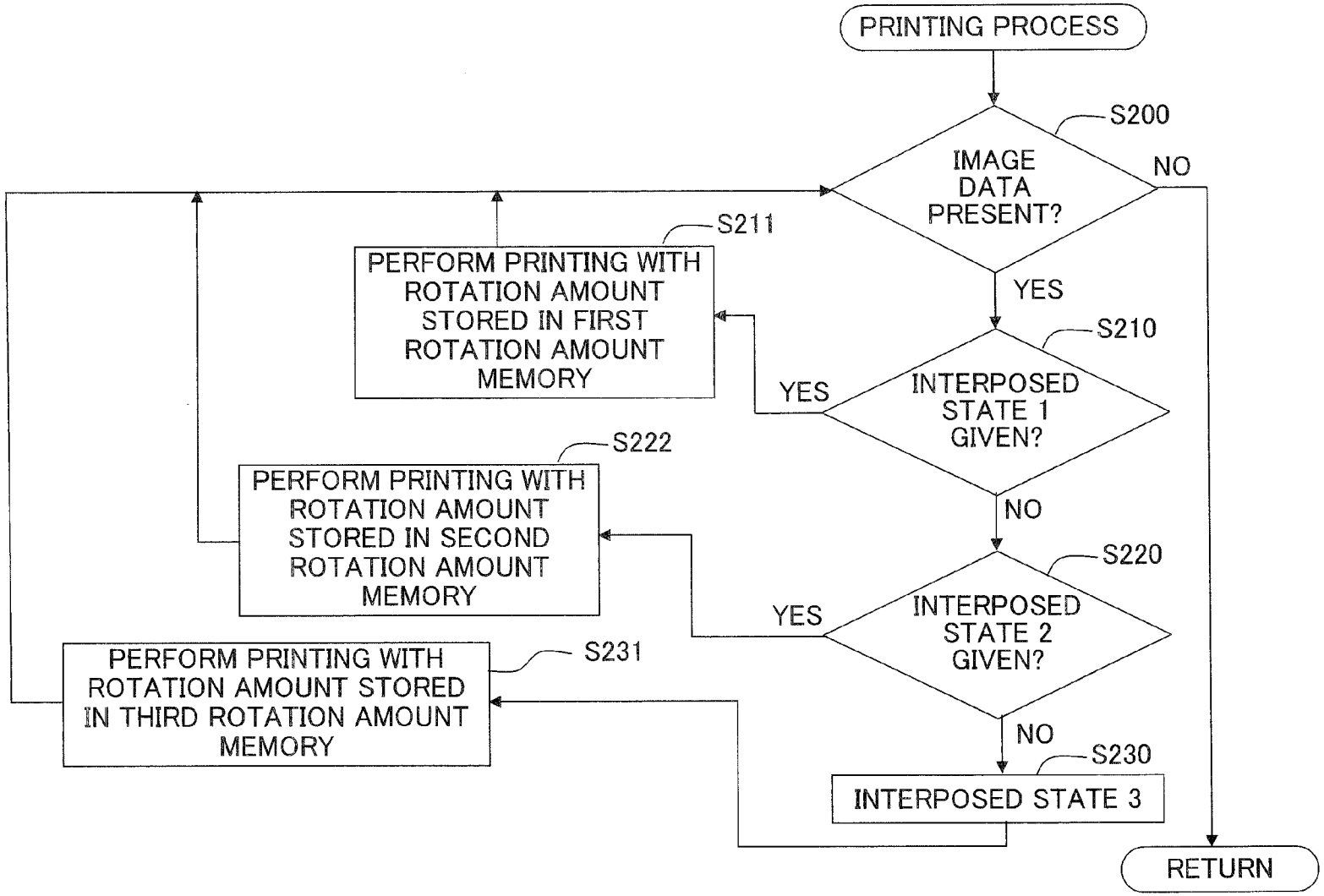
FIG. 19 shows a flow chart illustrating a printing process shown in FIG. 16B.

The printing process in Step S14 shown in FIG. 16B will be described in detail with reference to FIG. 19.

An explanation will now be made about a method for calculating the transport position of the recording paper P during the image recording. In this calculating method, the transport position of the recording paper P is calculated assuming that the measurement start position is provided when the forward end position of the recording paper P is disposed at the nip position 60A. For example, when the recording paper P, which is stacked in the paper feed cassette 78, is subjected to the printing, then the recording paper P is fed by the feed section 15, and the recording paper P is fed until the forward end of the recording paper P is positioned at the nip position 60A. When the printing is performed by using the manual feed tray 20, then the forward end of the recording paper P is brought into contact with the transport roller pair 160, and the recording paper P is placed in a state in which the forward end is disposed at the nip position 60A.

The rotation amount of the transport roller 60 is calculated based on the detection signal of the rotary encoder 97 for detecting the rotation amount of the transport roller 60, when the recording paper P is transported by the transport roller 60 from the state in which the forward end position of the recording paper P is disposed at the nip position 60A. In other words, the transport amount from the nip position 60A is calculated for the recording paper P to be transported by the transport roller 60.

On the other hand, the backward end position of the recording paper P is calculated on the basis of the transport amount of the recording paper P from the forward end position and the size of the recording paper P. Alternatively, the backward end position of the recording paper P may be calculated on the basis of the detection signal of the rotary encoder 97 obtained when the backward end of the recording paper P has passed through the registration sensor 110 in accordance with the transport. The size of the recording paper P is determined by the instruction from the operator and/or the size data included in the printing data supplied from an external terminal such as a personal computer or the like connected to the concerning multifunction machine 10.

As for the judgment about the respective interposed states of the recording paper P, the recording paper P is judged to be in the interposed state 1 if the forward end of the recording paper P does not arrive at the nip position 62A based on the rotation amount of the transport roller 60 calculated in accordance with the detection signal of the rotary encoder 97. Similarly, the recording paper P is judged to be in the interposed state 2 if the forward end of the recording paper P arrives at the nip position 62A and the backward end of the recording paper P does not arrive at the nip position 60A. The recording paper P is judged to be in the interposed state 3 if the backward end of the recording paper P arrives at the nip position 60A.

When the printing process is started, it is firstly judged whether or not the image data subjected to the printing is present (S200). In this case, the image data is the image data corresponding to an amount of 1 page. If the image data is absent (S200: NO), the concerning printing process comes to an end.

If the image data subjected to the printing is present (S200: YES), it is judged whether or not the recording paper P is in the interposed state 1 based on the rotation amount of the transport roller 60 calculated by the detection signal of the rotary encoder 97 as described above (S210). If it is judged that the recording paper P is in the interposed state 1 (S210: YES), the printing is performed by using the rotation amount stored in the first rotation amount memory 93C in Step S119. In this printing, the process is performed such that the recording paper P is transported in the rotation amount determined in the rotation amount determining process after the recording on the recording paper P performed by the recording head 31. The routine returns to Step S200 again, and it is judged whether or not the image data subjected to the printing is present. The printing is performed by using the rotation amount stored in the first rotation amount memory 93C until the interposed state of the recording paper P is changed (S210: NO) or the printing of the image data comes to an end (S200: NO).

If the image data subjected to the printing is present (S200: YES), and it is judged that the recording paper P is not in the interposed state 1 based on the rotation amount of the transport roller 60 calculated in accordance with the detection signal of the rotary encoder 97 as described above (S210: NO), then it is judged whether or not the recording paper P is in the interposed state 2 (S220: YES). If it is judged that the recording paper P is in the interposed state 2 (S220: YES), the printing is performed by using the rotation amount stored in the second rotation amount memory 93D. In this printing, the process is performed such that the recording paper P is transported in the rotation amount determined in the rotation amount determining process after the recording on the recording paper P performed by the recording head 31. The routine returns to Step S200 again, and it is judged whether or not the image data subjected to the printing is present. The printing is performed by using the rotation amount stored in the second rotation amount memory 93D until the interposed state of the recording paper P is changed (S220: NO) or the printing of the image data comes to an end (S200: YES).

If the image data subjected to the printing is present (S200: YES), it is judged that the recording paper P is not in the interposed state 1 (S210: NO), and it is judged that the recording paper P is not in the interposed state 2 (S220: NO) based on the rotation amount of the transport roller 60 calculated in accordance with the detection signal of the rotary encoder 97 as described above, then it is judged that the recording paper P is in the interposed state 3 (S230). In this case, the printing is performed by using the rotation amount stored in the third rotation amount memory 93E. In this printing, the process is performed such that the recording paper P is transported in the rotation amount determined in the rotation amount determining process after the recording on the recording paper P performed by the recording head 31. The routine returns to Step S200 again, and it is judged whether or not the image data subjected to the printing is present. The printing is performed by using the rotation amount stored in the third rotation amount memory 93E until the printing of the image data comes to an end (S200: YES).

Figure 12:
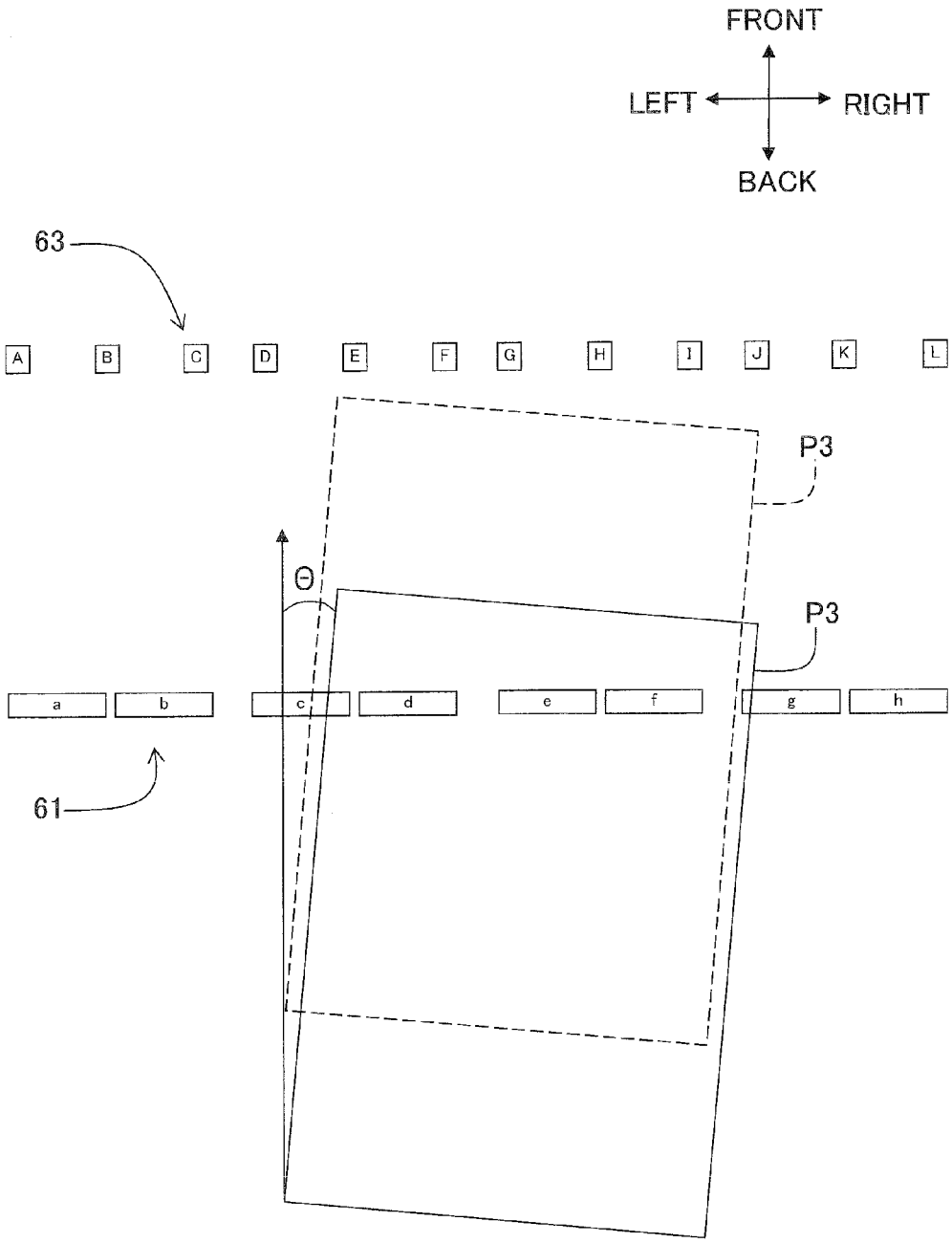
FIG. 12 schematically shows a situation in which the recording paper sheet, which is obliquely transported, is in the interposed state 1.
Figure 13:
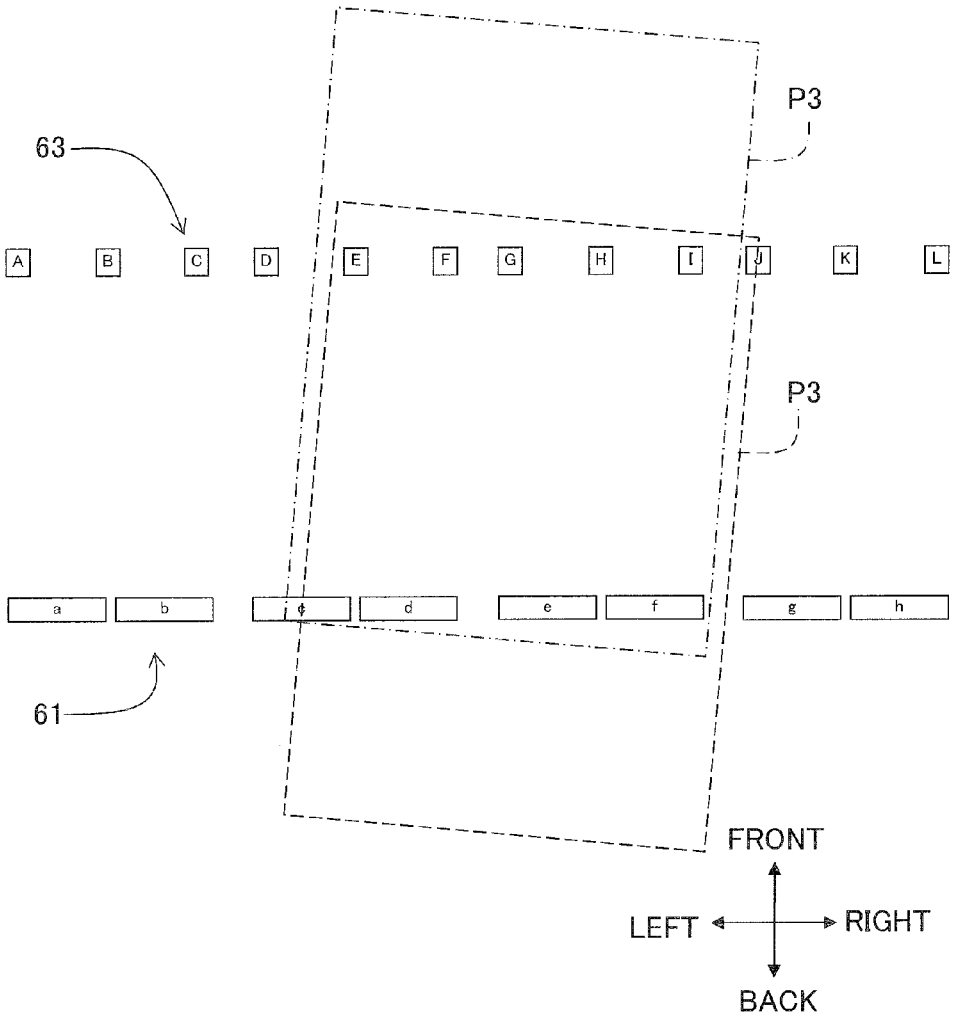
FIG. 13 schematically shows a situation in which the recording paper sheet, which is obliquely transported, is in the interposed state 2.
Figure 14:
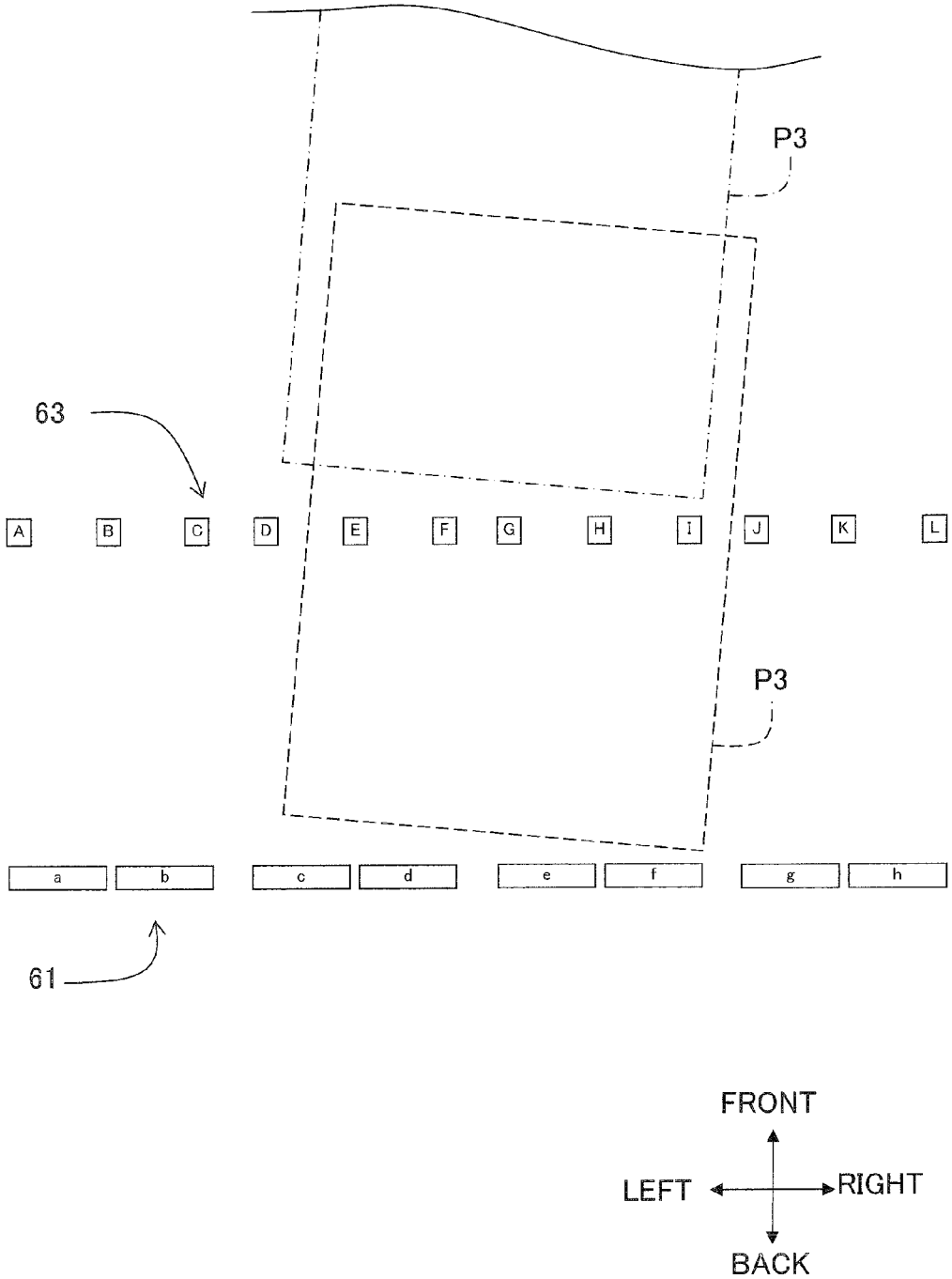
FIG. 14 schematically shows a situation in which the recording paper sheet, which is obliquely transported, is in the interposed state 3.
Figure 15:
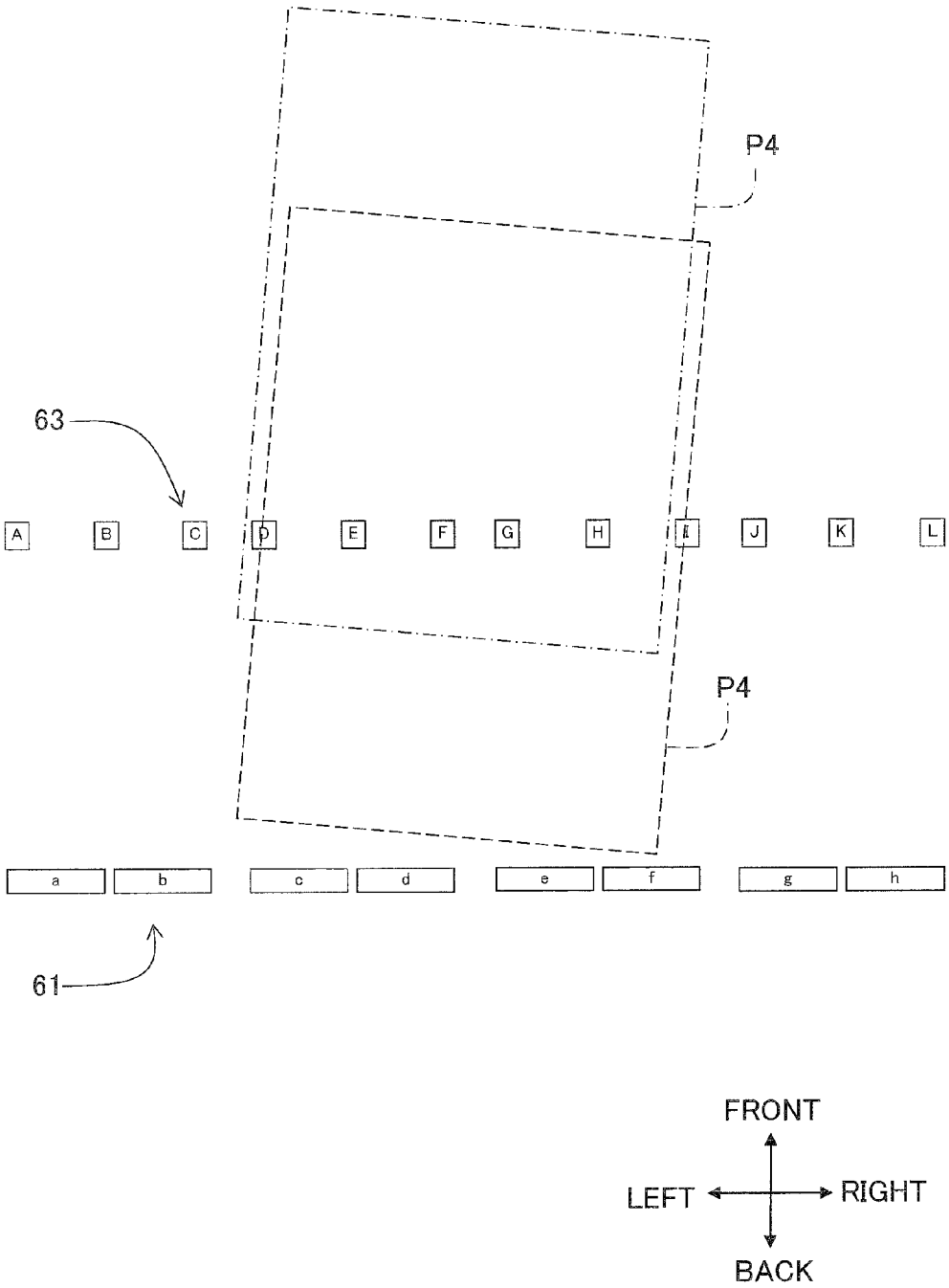
FIG. 15 schematically shows a situation in which the recording paper sheet, which is obliquely transported, is in the interposed state 3.
Figure 18A:
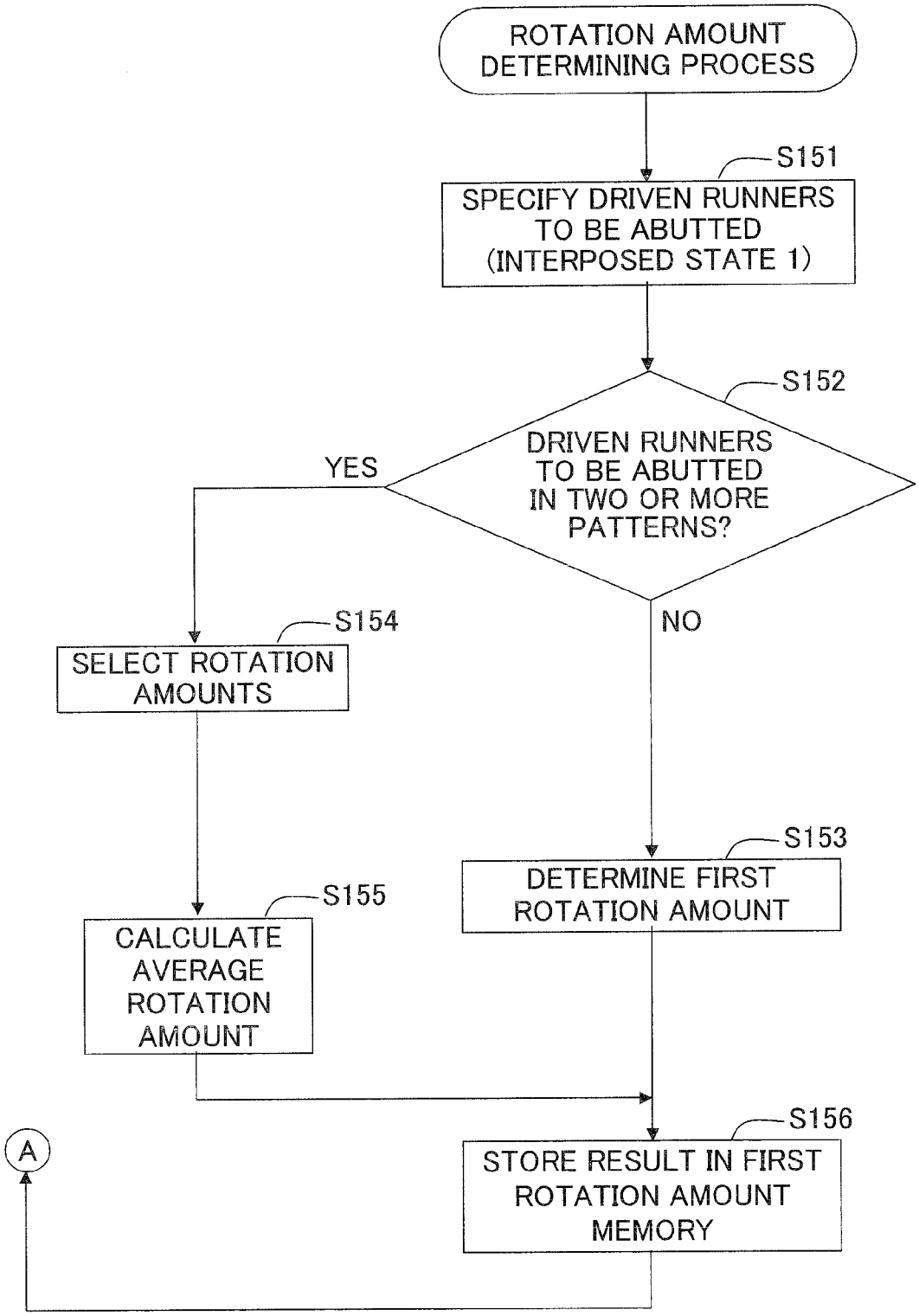
FIGS. 18A, 18B and 18C show a flow chart illustrating a modified embodiment of the rotation amount determining process shown in FIG. 16B according to the embodiment of the present invention.
Figure 18B:
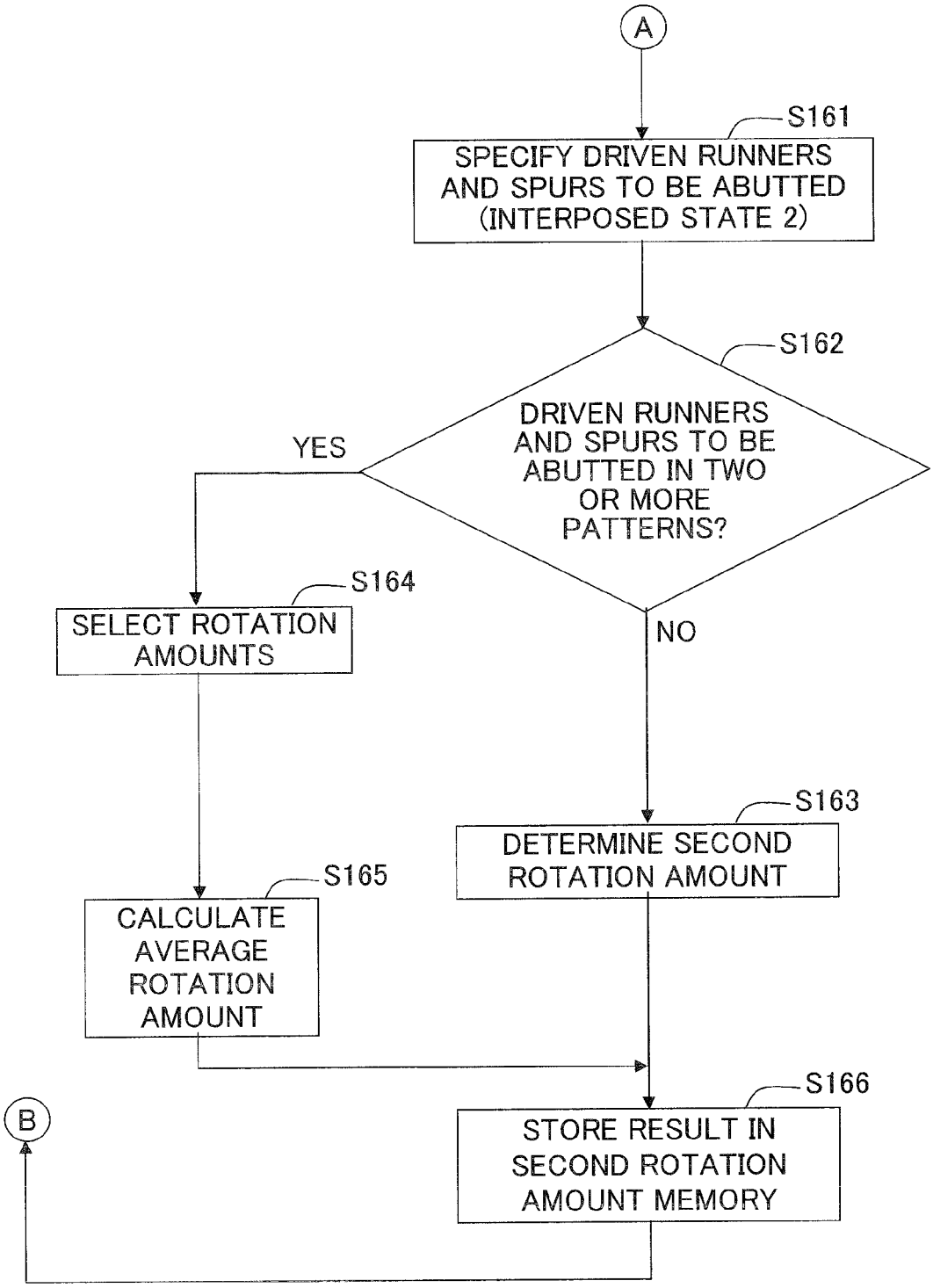
Figure 18C:
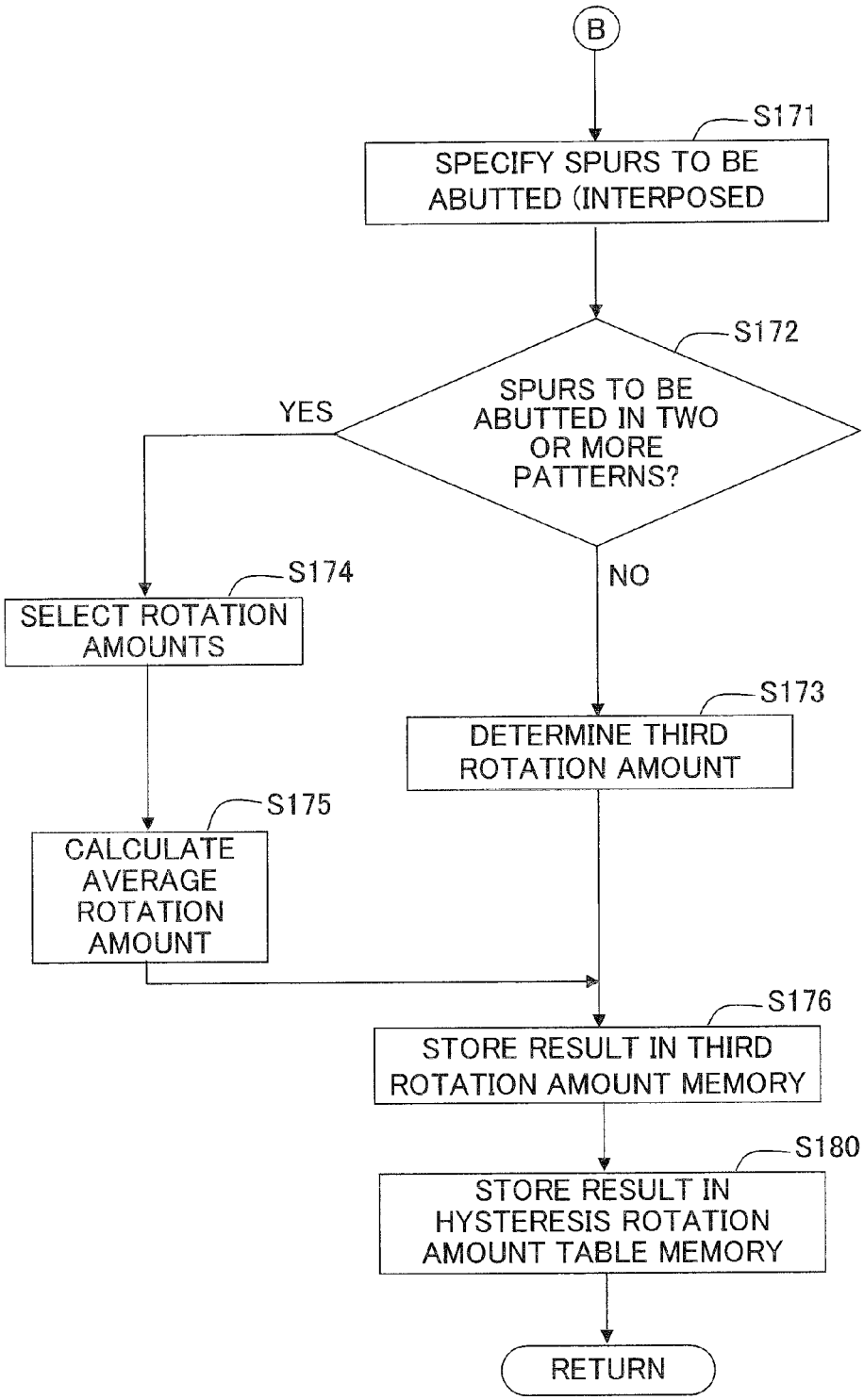

An explanation will be made with reference to FIGS. 12 to 15 and a flow chart shown in FIGS. 18A to 18C about details of a modified embodiment of the rotation amount determining process of the multifunction machine 10 (Step S13 shown in FIG. 16B). In FIGS. 12 to 15, in order to simplify the explanation, the transport roller 60 and the paper discharge roller 62 are omitted from the respective drawings. The respective individual members of the driven runners 61 are designated as a, b, c, d, e, f, g, and h from the left in each of the drawings. The respective individual members of the spurs 63 are designated as A, B, C, D, E, F, G, H, I, J, K, and L from the left in each of the drawings. Broken lines shown in FIGS. 12 and 14 indicate the positions of the recording paper P3 to which the recording paper P3, which is depicted by solid lines in FIG. 12, are assumed to be transported thereafter. Further, alternate long and short dash lines shown in FIG. 15 indicate the position of the recording paper P4 to which the recording paper P4, which is depicted by broken lines in FIG. 15, is assumed to be transported thereafter.

Figure 17:
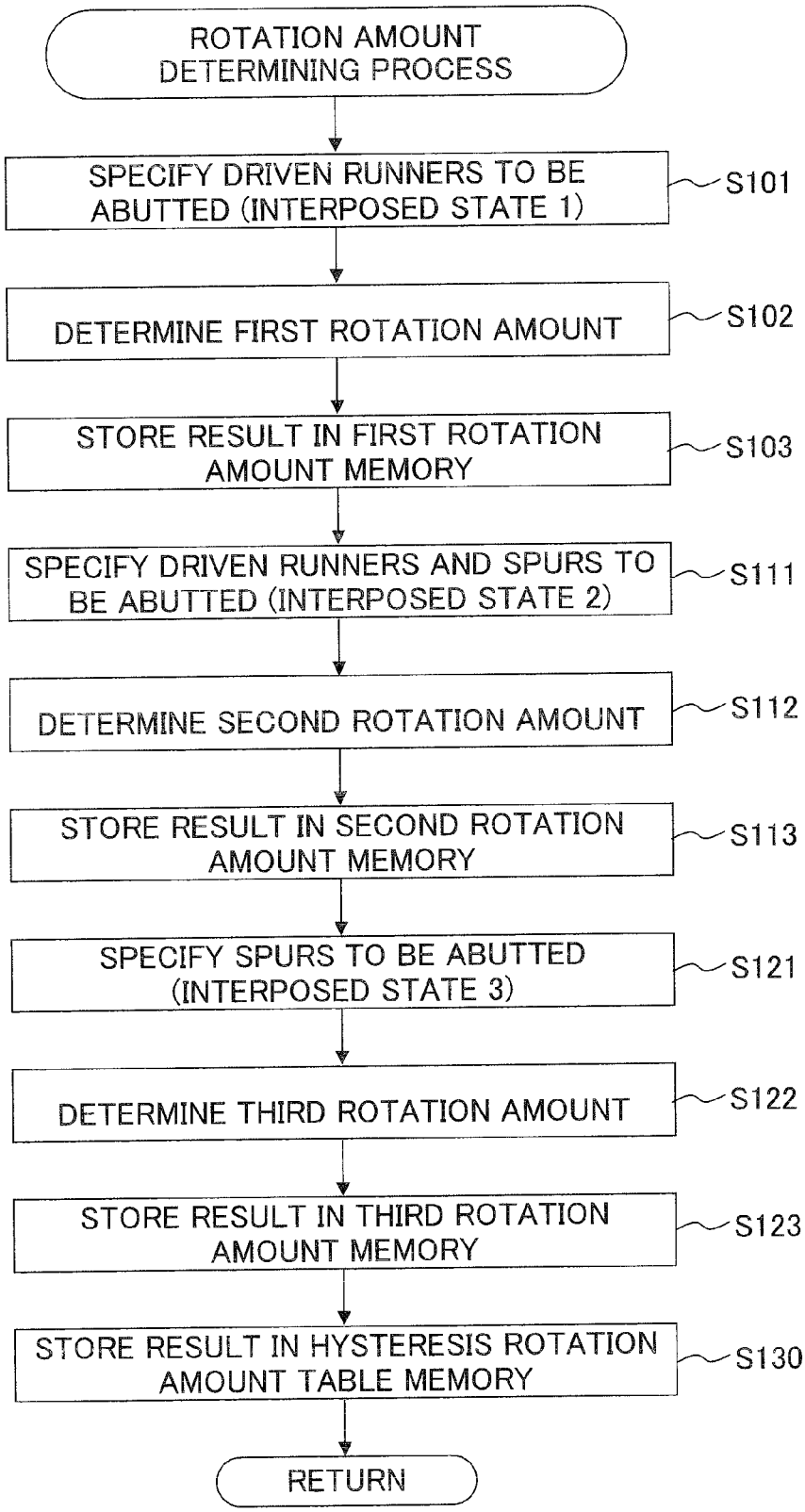
FIG. 17 shows a flow chart illustrating a rotation amount determining process shown in FIG. 16B according to the embodiment of the present invention.

In the rotation amount determining process, the driven runners 61 or the spurs 63, which are to be brought into contact with the recording paper P in the respective interposed states specified in Step S101, Step S111, and Step S121 in the flow chart shown in FIG. 17, are sometimes changed as the recording paper is transported, depending on the degree of the oblique transport and the position in the left-right direction of the recording paper. In such situations, if the rotation amount, which is obtained when the oblique transport is not caused, is applied as it is, then the recording paper cannot be transported accurately, and the image quality is lowered. Accordingly, when the driven runners 61 or the spurs 63, which are brought into contact with the recording paper P, are changed during the transport due to the oblique transport, the rotation amount is set assuming that the driven runners 61 or the spurs 63, which are brought into contact with the recording paper P during the transport, are changed. In this modified embodiment, the interposed state is such a state that the recording paper P is interposed by the transport roller pair 160 or the paper discharge roller pair 162 over the both side ends, which is set depending on the numbers and the positions of the driven runners 61 or the spurs 63 to be brought into contact with the recording paper P.

Accordingly, at first, the driven runners 61, which are to be brought into contact with the recording paper P in the transport of the recording paper in the interposed state 1, are specified based on the recording paper side end positions stored in the recording paper side end position memory 93A and the oblique transport amount stored in the oblique transport amount memory 93B (S151). In this case, the interposed state 1 is such a state that the recording paper P3 is interposed by only the transport roller pair 160, for example, as shown in FIG. 12.

In Step S151, the following method is available to specify the driven runners 61. That is, the route, in which the recording paper P3 is transported, is calculated from the recording paper side end positions T1, T2 stored in the recording paper side end position memory 93A and the oblique transport amount stored in the oblique transport amount memory 93B, and the driven runners 61 are specified by associating the route with the arrangement positions of the driven runners 61. For example, when the recording paper P3 is positioned at the recording paper position as shown in FIG. 12, the recording paper P3 is initially brought into contact with "c, d, e, f, g" of the driven runners 61. However, when the recording paper P3 is transported frontwardly from the initial recording paper position as indicated by the position of the recording paper P3 depicted by alternate long and short dash lines in FIG. 12, the recording paper P3 is brought into contact with "c, d, e, f" of the driven runners 61 just before the recording paper P3 is interposed by the paper discharge roller pair 162 (spurs 63). In this case, the driven runners 61, which are brought into contact with the recording paper P3, are specified as those of two patterns of "c, d, e, f, g" and "c, d, e, f" of the driven runners 61. Therefore, it is judged in Step S152 that the driven runners 61, which are brought into contact with the recording paper P3, are in the two or more patterns (S152: YES).

Subsequently, the two patterns of the driven runners 61, with which the recording paper P3 is brought into contact in the interposed state 1, are associated with the rotation amount table shown in FIG. 20A stored in the rotation amount table memory 92A. The driven runners 61, with which the recording paper P3 is brought into contact in the interposed state 1, are "c, d, e, f, g" and "c, d, e, f" of the driven runners 61. Therefore, two patterns of the rotation amount 2 and the rotation amount 1 are selected for the rotation amount for the recording paper P3 in the interposed state 1 according to the rotation amount table shown in FIG. 20A stored in the rotation amount table memory 92A (S154). An average or mean rotation amount of the two patterns is calculated (S155). The average rotation amount, which is calculated in Step S155, is stored in the first rotation amount memory 93C (S156).

If it is judged that the driven runners 61, which are brought into contact with the recording paper P3, are not in the two or more patterns (S152: NO), i.e., if the recording paper P3 is transported without causing any oblique transport or if the driven runners 61 to be brought into contact with the recording paper P3 are not changed even in the case of the oblique transport, then the process is performed as in the flow chart shown in FIGS. 16A and 16B described above. Therefore, one rotation amount, which is determined based on the driven runners 61 to be brought into contact with the recording paper P3, is determined as the first rotation amount (S153).

Subsequently, the driven runners 61 and the spurs 63, which are brought into contact with the recording paper P3 in the transport of the recording paper P3 in the interposed state 2, are specified based on the recording paper side end positions stored in the recording paper side end position memory 93A and the oblique transport amount stored in the oblique transport amount memory 93B (S161). In this case, the interposed state 2 is such a state that the recording paper P3 is interposed by the transport roller pair 160 and the paper discharge roller pair 162, for example, as shown in FIG. 13.

In Step S161, the following method is available to specify the driven runners 61 and the spurs 63. That is, the route, in which the recording paper P3 is transported, is calculated from the recording paper side end positions T1, T2 stored in the recording paper side end position memory 93A and the oblique transport amount stored in the oblique transport amount memory 93B, and the driven runners 61 and the spurs 63 are specified by allowing the route to correspond to the arrangement positions of the driven runners 61 and the spurs 63. For example, when the recording paper P3 is positioned at the recording paper position depicted by broken line in FIG. 13, the recording paper P3 is initially brought into contact with "c, d, e, f" of the driven runners 61 and "E, F, G, H, I, J" of the spurs. However, when the recording paper P3 is transported frontwardly from the initial recording paper position as indicated by the position of the recording paper P3 depicted by alternate long and short dash lines in FIG. 13, the recording paper P3 is brought into contact with "c, d, e, f" of the driven runners 61 and "E, F, G, H, I" of the spurs 63 just before the recording paper P3 is not interposed by the transport roller pair 160 (driven runners 61). In this case, the driven runners 61 and the spurs 63, which are brought into contact with the recording paper P3, are specified as those of two patterns of "c, d, e, f" of the driven runners 61 and "E, F, G, H, I, J" of the spurs 63 as well as "c, d, e, f" of the driven runners 61 and "E, F, G, H, I" of the spurs 63. Therefore, it is judged in Step S162 that the driven runners 61 and the spurs 63, which are brought into contact with the recording paper P3, are in the two or more patterns (S162: YES).

Subsequently, the two patterns of the driven runners 61 and the spurs 63, with which the recording paper P3 is brought into contact in the interposed state 2, are associated with the rotation amount table shown in FIG. 20A stored in the rotation amount table memory 92A. The driven runners 61 and the spurs 63, with which the recording paper P3 is brought into contact in the interposed state 2, are "c, d, e, f" of the driven runners 61 and "E, F, G, H, I, J" of the spurs 63 as well as "c, d, e, f" of the driven runners 61 and "E, F, G, H, I" of the spurs 63. Therefore, two patterns of the rotation amount 6 and the rotation amount 3 are selected for the rotation amount for the recording paper P3 in the interposed state 2 according to the rotation amount table shown in FIG. 20A stored in the rotation amount table memory 92A (S164). An average rotation amount of the two patterns is calculated (S165). The average rotation amount, which is calculated in Step S165, is stored in the second rotation amount memory 93D (S166).

If it is judged that the driven runners 61 and the spurs 63, which are brought into contact with the recording paper P3, are not in the two or more patterns (S162: NO), one rotation amount, which is determined based on the driven runners 61 and the spurs 63 to be brought into contact with the recording paper P3, is determined as the second rotation amount as described above (S163).

Subsequently, the spurs 63, which are brought into contact with the recording paper P3 in the transport of the recording paper P3 in the interposed state 3, are specified based on the recording paper side end positions stored in the recording paper side end position memory 93A and the oblique transport amount stored in the oblique transport amount memory 93B (S171). In this case, the interposed state 3 is such a state that the recording paper P3 is interposed by only the paper discharge roller pair 162, for example, as shown in FIG. 14.

In Step S171, the following method is available to specify the rollers. That is, the route, in which the recording paper P3 is transported, is calculated from the recording paper side end positions T1, T2 stored in the recording paper side end position memory 93A and the oblique transport amount stored in the oblique transport amount memory 93B, and the rollers are specified by allowing the route to correspond to the arrangement positions of the spurs 63. For example, when the recording paper P3 is positioned at the recording paper position depicted by broken line in FIG. 14, the recording paper P3 is initially brought into contact with "E, F, G, H, I" of the spurs 63. However, in this case, the recording paper P3 is brought into contact with "E, F, G, H, I" of the spurs 63 in the same manner as in the initial state immediately after the recording paper P3 is released from being interposed by the paper discharge roller pair 162 (spurs 63), as the recording paper P3 is transported frontwardly from the initial recording paper position, as indicated by the position of the recording paper P3 depicted by alternate long and short dash lines in FIG. 14, unlike the example described above. In this case, the spurs 63, which are brought into contact with the recording paper P3, are specified as those of one pattern of "E, F, G, H, I" of the spurs 63. Therefore, it is judged in Step S172 that the spurs 63, which are brought into contact with the recording paper P3, are not in the two or more patterns (S172: NO).

Subsequently, the spurs 63, with which the recording paper P3 is brought into contact in the interposed state 3 and which are specified in Step S171, are associated with the rotation amount table shown in FIG. 20A stored in the rotation amount table memory 92A and thus the third rotation amount, is the rotation amount in the interposed state 3, is determined. The spurs 63, with which the recording paper P3 is brought into contact in the interposed state 3, are "E, F, G, H, I" of the spurs 63. Therefore, the third rotation amount for the recording paper P3 in the interposed state 3 is determined to be the rotation amount 10 from the rotation amount table shown in FIG. 20A stored in the rotation amount table memory 92A (S173). The third rotation amount, which is determined in Step S173, is stored in the third rotation amount memory 93E (S180).

Further, when the recording paper P4 is disposed at the position depicted by broken line in FIG. 15, the spurs 63, which are brought into contact with the recording paper P4 depicted by alternate long and short dash lines to indicate the position of the recording paper P4 transported thereafter, is changed as compared with the spurs 63 which are initially brought into contact with the recording paper P4 depicted by broken lines. Namely, as shown in FIG. 15, the recording paper P4 is initially brought into contact with "D, E, F, G, H, I" of the spurs 63. However, when the recording paper P4 is transported frontwardly from the initial recording paper position, the recording paper P4 is brought into contact with "D, E, F, G, H" of the spurs 63 just before the recording paper P4 is not interposed by the paper discharge roller pair 163 (spurs 63). In this case, the spurs 63, which are brought into contact with the recording paper P4, are specified to be those in two patterns of "D, E, F, G, H, I" of the spurs 63 and "D, E, F, G, H" of the spurs 63. Therefore, it is judged in Step S172 that the spurs 63, which are brought into contact with the recording paper P4, are in the two or more patterns (S172: YES).

When the recording paper P4 is brought into contact with "D, E, F, G, H, I" of the spurs 63 and "D, E, F, G, H" of the spurs 63, two patterns of the rotation amount 8 and the rotation amount 7 are selected according to FIG. 20A (S174). As described above, an average rotation amount of the two patters is calculated (S175). The average rotation amount, which is calculated in Step S175, is stored in the third rotation amount memory 93E (S176).

Subsequently, the recording paper side end positions stored in the recording paper side end position memory 93A, the oblique transport amount stored in the oblique transport amount memory 93B, the first rotation amount stored in the first rotation amount memory 93C, the second rotation amount stored in the second rotation amount memory 93D, and the third rotation amount stored in the third rotation amount memory 93E are united and stored as the hysteresis rotation amount table in the hysteresis rotation amount table memory 94A as shown in FIG. 21C (S180). In the case of the recording paper P3 shown in FIGS. 12 to 14, the hysteresis rotation amount table as shown in FIG. 21C is prepared and stored. Thus, the concerning rotation amount determining process (Step S13 shown in FIG. 16B) comes to an end.

As described above, in this modified embodiment, when the recording paper is transported obliquely, and the driven runners 61 or the spurs 63, which are brought into contact with the recording paper, are changed during the transport, then the average rotation amount is determined based on the rotation amount before the change and the rotation amount after the change. In the case of the position of the recording paper P3, as shown in FIG. 21C, the transport is performed by using the average rotation amount which is the average or mean of the rotation amount 1 and the rotation amount 2 when the recording paper P3 is transported in the interposed state 1, by using the average rotation amount which is the average or mean of the rotation amount 6 and the rotation amount 3 when the recording paper P3 is transported in the interposed state 2, and by using the rotation amount 10 when the recording paper P3 is transported in the interposed state 3. In this way, when the recording paper is transported obliquely, and the driven runners 61 or the spurs 63, which are brought into contact with the recording paper, are changed, then the average rotation amount, which is the average of the rotation amount before the change and the rotation amount after the change, is set. Accordingly, it is possible to respond to the change of the transport amount caused by the change of the interposing force during the transport, and it is possible to realize the accurate transport. Therefore, it is possible to suppress the deterioration of the image quality.

As described above, in this embodiment, the rotation amount, which is determined in the rotation amount determining process based on the side end positions of the recording paper and the oblique transport amount, is stored in the hysteresis rotation amount table memory 94A. If the calculated oblique transport amount and the side end positions of the recording paper subjected to the reading are the same as or identical with the oblique transport amount and the side end positions of the recording paper stored in the hysteresis rotation amount table memory 94A, it is possible to omit the process to be performed in the rotation amount determining process. Therefore, the process speed is improved in the image recording, and thus the throughput is improved.

In the embodiment of the present invention, the explanation has been made about the example in which the rotation amount of the transport roller 60 is set in each of the interposed states before the image recording by detecting the side end positions of the recording paper before the image recording. As described above, in the ink-jet recording method based on the serial system, the recording of the image on the recording paper P is realized by alternately repeating the recording operation which is performed by discharging the inks by means of the recording head 30 while moving the carriage 31 in the left-right direction and the line feed operation in which the recording paper on the platen 34 is transported by the predetermined amount in the transport direction 6 by means of the transport roller pair 160 and the paper discharge roller pair 162. For example, if the reading is performed every time when the line feed is performed, it is possible to detect the position of the recording paper during the transport. Therefore, the position of the recording paper during the transport can be discriminated more correctly as compared with the detecting method according to the embodiment of the present invention. Therefore, if the rotation amount is set every time when the line feed operation is performed, it is possible to set the rotation amount depending on the recording paper position during the transport. Further, if the side end positions of the recording paper are read every time when the line feed is performed, and the rotation amount is set every time when the reading is performed, then the position of the recording paper during the transport can be detected correctly even when the recording paper is obliquely transported. In this case, it is unnecessary to perform the calculation in order to determine the oblique transport amount as in the embodiment of the present invention. Therefore, it is possible to mitigate the calculation load on CPU 91.

When the rotation amount is set every time when the line feed is performed as described above, then only the recording paper side end positions read for the first time and the second time are stored in the hysteresis rotation amount table memory 94A, and the respective rotation amounts, which are determined by all of the reading operations for the first time and the followings, are stored beforehand. The storage in the hysteresis rotation amount table memory 94A as described above is more effective when the rotation amount is set every time when the line feed is performed as described above. For example, when the printing is performed on the first sheet of the recording paper, the side end positions of the recording paper read for the first time and the second time are stored beforehand. The reading is executed for the side end positions of the recording paper for the first time and the second time in relation to each of the second sheet of the recording paper and the followings. If the reading positions read for the first time and the second time are identical between the first sheet and the second sheet and the followings of the recording paper in relation to the respective sheets of the recording paper, it is judged that the transport is performed with the same recording paper position as that of the first sheet of the recording paper. If it is judged that the position is the same, all of the rotation amounts, which are set for the first sheet of the recording paper and which are stored in the hysteresis rotation amount table memory 94A, are used as they are for the rotation amounts to be used for the second sheet of the recording paper and the followings.

In this case, if the side end positions of the recording paper, which are obtained by the reading for the first time and the second time, are identical in the reading of the first sheet of the recording paper and the second sheet of the recording paper and the followings, the positions of the respective sheets of the recording paper are regarded to be identical in the transport to be performed thereafter, because it can be estimated that the amount of the oblique transport of the recording paper and the direction of the oblique transport are identical. In this case, the reason, why the reading is performed for the second time, is as follows. That is, in the reading for the first time, it is possible to specify the amount of the oblique transport of the recording paper, but it is impossible to specify the direction of the oblique transport of the recording paper. Therefore, the direction of the oblique transport is specified by performing the reading for the second time after the reading for the first time. In this way, if the reading positions of the recording paper are identical with each other between the first time and the second time, then the amounts of the oblique transport are identical with each other, and the directions of the oblique transport are identical with each other. It can be estimated that the amounts of the oblique transport and the directions of the oblique transport may be also identical at the reading positions of the recording paper for the third time and the followings. Therefore, if the reading positions of the respective sheets of the recording paper, which are subjected to the reading twice, are identical with each other, it is judged that the positions of the respective sheets of the recording paper are identical with each other.

Therefore, if the side end positions of the recording paper, which are obtained by the reading operations for the first time and the second time, are identical with each other, then the process is omitted for the reading for the third time and the followings for the second sheet of the recording paper and the followings, or the process is omitted for the calculation of the rotation amount upon the reading. The process speed is improved in the image recording, and the throughput is improved.

In the embodiment of the present invention, the explanation has been made about the case in which the rotation amount table memory 92A in which the rotation amounts are stored respectively is stored in ROM 92. However, there is no limitation thereto. Those stored in ROM 92 may be the reference rotation amount of the transport roller 60 and the correction coefficient required to correct the reference rotation amount. As shown in FIG. 20B, various correction coefficients are prepared corresponding to the positions in the left-right direction or the number and the positions in the left-right direction of the driven runners 61 or the spurs 63 to be brought into contact with the recording paper. In this case, when the rotation amount is corrected, the correction coefficient is determined depending on the positions in the left-right direction or the number and the positions in the left-right direction of the driven runners 61 or the spurs 63 to be brought into contact with the recording paper. The reference rotation amount is multiplied by the correction coefficient ((reference rotation amount)×(correction coefficient)) by using the determined correction coefficient. Thus, it is possible to determine the corrected rotation amount. The use of the hysteresis rotation amount table memory 94A is more effective when the correction coefficients are stored, rather than when various rotation amounts are stored in ROM 92 as described above, for the following reason. That is, if the side end positions of the recording paper are detected by the reading for the first time, the oblique transport amount is detected by the reading for the next or second time, and it is regarded that the detection results are identical with those having been previously stored, then the calculation, which would be required to correct the reference rotation amount, is omitted, and the rotation amount, which has been previously stored, is used. Thus, the process is simplified. Therefore, the process speed is improved in the image recording, and the throughput is improved.

When the corrected rotation amount is determined by multiplying the reference rotation amount by the correction coefficient as described above, for example, as shown in FIGS. 22A and 22B, the intrinsic correction coefficients, which are possessed by the driven runners 61 or the spurs 63 respectively, may be stored beforehand. In this case, when the driven runners 61 or the spurs 63, which are to be brought into contact with the recording paper, are determined, the average or mean of the correction coefficients possessed by the driven runners 61 or the spurs 63 to be brought into contact with the recording paper is calculated as shown in FIGS. 22C to 22G. In this procedure, FIGS. 22C to 22G are prepared based on FIGS. 20B, 22A, and 22B. Each of the correction coefficients shown in FIGS. 22C to 22G is determined as the arithmetic mean such that the sum total of the intrinsic correction coefficients possessed by the driven runners 61 or the spurs 63 to be brought into contact with the recording paper P respectively is divided by the number of the driven runners 61 or the spurs 63, and the obtained result is temporarily stored in RAM 93.

The reference rotation amount may be multiplied by the calculated average or mean of the correction coefficients. In this case, in order to transport the recording paper more accurately, as shown in FIGS. 20A and 20B, it is necessary to prepare a huge number of the rotation amounts and a huge number of the correction coefficients with respect to the rollers to be brought into contact with the recording paper. ROM 92 is occupied in an increased ratio by the area for storing the rotation amounts and the correction coefficients. However, as shown in FIGS. 22A and 22B, when only the intrinsic correction coefficients, which are possessed by the driven runners 61 or the spurs 63 respectively, are stored in ROM 92, it is possible to decrease the storage area in ROM 92.

In the embodiment of the present invention, the operation is performed in the recording of the image such that the line feed operation, in which the recording paper P is transported after performing the recording by means of the recording head 31, is repeated. However, there is no limitation thereto. The present invention is also applicable, for example, to such a method that the image is recorded while performing the transport without stopping the recording paper P, provided that the recording paper P is interposed during the transport. In such a procedure, the media sensor 51, which is installed on the carriage 31 that is reciprocatively movable in the left-right direction, is used for the reading of the recording paper in the embodiment of the present invention. However, the reading of the recording paper can be realized by providing a detecting section which can read the side ends of the recording paper by traversing the both side ends of the recording paper or a detecting section of the full line type which is greater than the both side ends of the recording paper.

In the embodiment of the present invention, the rotation amounts in the respective interposed states are calculated before the recording paper is transported from the cueing position. However, there is no limitation thereto. The rotation amounts may be calculated for the respective interposed states, for example, such that the first rotation amount is determined when the recording paper P is disposed at the position assumed to be in the interposed state 1, the second rotation amount is determined when the recording paper P is disposed at the position assumed to be in the interposed state 2, and the third rotation amount is determined when the recording paper P is disposed at the position assumed to be in the interposed state 3, on the basis of the detection signal of the rotary encoder 97 while the reading of the recording paper P is performed every time when the line feed operation is performed.

In the embodiment of the present invention, the explanation has been made about the case in which the number of the driven runners 61 of a to h is eight, and the number of the spurs 63 of A to L is twelve. However, the numbers of the driven runners 61 and the spurs 63 are not limited thereto. For example, the number of the driven runners 61 may be ten or six, and the number of the spurs 63 may be ten or fourteen, wherein it is possible to adopt any numbers. In this case, the rotation amount, which is stored in the rotation amount table memory 92A, should be appropriately set depending on the number of the driven runners 61 and the number of the spurs 63 as described above.

In the embodiment of the present invention, the rotation amount is set by comparing the recording paper and the abutting portion taking notice of each one of the driven runners 61 and the spurs 63. However, a certain number of areas, which are comparted in the front-back direction, may be set beforehand, and the rotation amount may be set depending on the area when the recording paper passes. In this case, the number of the driven runners 61 or the number of the spurs 63 is not limited to the plural. The present invention is also applicable, for example, to a case in which the driven runner 61 and/or the spur 63 is formed with one cylindrical form.

In the embodiment of the present invention, the arrangement is provided to drive the paper discharge roller 62 such that the paper discharge roller 62 is driven and rotated by the driving force transmitted via the intermediate gear 57 and the belt 58 from the transport roller 60 which receives the driving force from the transport motor 73 as the driving source. As for the rotation amount, the attention is focused on only the transport roller 60. However, there is no limitation thereto. For example, when the transport roller 60 and the paper discharge roller 62 are constructed such that the transport roller 60 and the paper discharge roller 62 have driving sources respectively, it is appropriate to set the respective rotation amounts of the transport roller 60 and the paper discharge roller 62.

What is claimed is:

1. An image recording apparatus which records an image on a recording medium, the image recording apparatus comprising:

a first roller pair comprising:

a first driving roller to which a driving force is transmitted from a driving source; and a first driven roller arranged to face the first driving roller and which rotates in a state of interposing the recording medium therebetween to transport the recording medium in a first direction;

a recording section which records the image on the recording medium transported by the first roller pair;

a position detecting section which detects a position of the recording medium with respect to the first roller pair in a second direction perpendicular to the first direction before the recording section starts recording of the image;

a determining section which determines a rotation amount of the first driving roller before the recording section starts the recording of the image; and a control unit which controls the first driving roller based on the rotation amount determined by the determining section so that the first roller pair transports the recording medium.

wherein the first driven roller comprises a plurality of first driven rollers which are arranged in the second direction;

wherein the image recording apparatus further comprises a specifying section which specifies a number of the first driven rollers to be brought into contact with the recording medium based on the position in the second direction of the recording medium detected by the position detecting section; and wherein the determining section determines the rotation amount depending on the number of the first driven rollers specified by the specifying section.

2. The image recording apparatus according to claim 1, wherein:

the recording section includes a recording head which discharges an ink and a carriage which carries the recording head and which is reciprocatively movable in the second direction;

the position detecting section includes a detector section which emits light toward the recording medium and which receives light reflected by light emission; and the detector section is installed on the carriage.

3. The image recording apparatus according to claim 1, further comprising:

an oblique transport amount detecting section which detects an oblique transport amount of the recording medium transported by the first roller pair;

a judging section which judges whether or not the first driven rollers, which are to be brought into contact with the recording medium, are changed while the first roller pair is transporting the recording medium based on the position in the second direction of the recording medium detected by the position detecting section and the oblique transport amount detected by the oblique transport amount detecting section; and a calculating section which calculates an average rotation amount as a mean rotation amount of the rotation amount corresponding to the first driven rollers before the first driven rollers are changed and the rotation amount corresponding to the first driven rollers after the first driven rollers are changed, if it is judged by the judging section that the first driven rollers are changed, wherein the determining section determines the average rotation amount calculated by the calculating section as the rotation amount of the first driving roller.

4. The image recording apparatus according to claim 1, further comprising an oblique transport amount detecting section which detects an oblique transport amount of the recording medium transported by the first roller pair, wherein the determining section determines the rotation amount based on the position in the second direction of the recording medium detected by the position detecting section and the oblique transport amount detected by the oblique transport amount detecting section.

5. The image recording apparatus according to claim 4, further comprising:

a storage section which stores the rotation amount determined in previous image recording and the oblique transport amount and the position in the second direction of the recording medium provided when the rotation amount is determined; and a comparing section which compares the oblique transport amount and the position in the second direction of the recording medium stored in the storage section with the oblique transport amount and the position in the second direction of the recording medium detected by the position detecting section, wherein the rotation amount, which is stored in the storage section, is determined as the rotation amount in present image recording if the oblique transport amount and the position in the second direction of the recording medium detected by the position detecting section are equivalent to the oblique transport amount and the position in the second direction of the recording medium stored in the storage section.

6. The image recording apparatus according to claim 4, wherein the recording section includes a recording head which discharges an ink and a carriage which carries the recording head and which is provided reciprocatively movably in the second direction; and the oblique transport amount detecting section includes an oblique transport amount detector section which emits light toward the recording medium and which receives light reflected by light emission, the oblique transport amount detector section being installed at the recording section.

7. The image recording apparatus according to claim 6, wherein the oblique transport amount detector section is the position detecting section.

8. The image recording apparatus according to claim 1, wherein:

the first roller pair is arranged on an upstream side in the first direction with respect to the recording section and which transports the recording medium to the recording section and the image recording apparatus further comprises a second roller pair comprising a second driving roller and a second driven roller, wherein the second roller pair is arranged on a downstream side in the first direction with respect to the recording section and the second roller pair transports the recording medium having the image recorded thereon by the recording section toward the downstream side;

the image recording apparatus further includes a state detecting section which detects a first state in which the recording medium is interposed by only the first roller pair, a second state in which the recording medium is interposed by the first roller pair and the second roller pair, and a third state in which the recording medium is interposed by only the second roller pair;

the determining section determines a first rotation amount as the rotation amount of the driving roller when the state detecting section detects the first state, a second rotation amount as the rotation amount of the driving roller when the state detecting section detects the second state, and a third rotation amount as the rotation amount of the driving roller when the state detecting section detects the third state; and the control unit controls the driving rollers of the first roller pair and the second roller pair based on the respective rotation amounts determined by the respective determining sections so that the recording medium is transported by the first roller pair and the second roller pair.

* * * * *